US007381511B2

(12) United States Patent
Ikegami et al.

(10) Patent No.: US 7,381,511 B2
(45) Date of Patent: Jun. 3, 2008

(54) PHOTORECEPTOR, IMAGE FORMING METHOD AND IMAGE FORMING APPARATUS USING THE PHOTORECEPTOR, PROCESS CARTRIDGE USING THE PHOTORECEPTOR AND COATING LIQUID FOR THE PHOTORECEPTOR

(75) Inventors: Takaaki Ikegami, Susono (JP); Tomoyuki Shimada, Shizuoka-ken (JP); Yasuo Suzuki, Fuji (JP); Nozomu Tamoto, Numazu (JP); Hidetoshi Kami, Numazu (JP); Yuuji Takana, Fujinomiya (JP)

(73) Assignee: Ricoh Company, Ltd., Tokyo (JP)

( * ) Notice: Subject to any disclaimer, the term of this patent is extended or adjusted under 35 U.S.C. 154(b) by 230 days.

(21) Appl. No.: 10/856,962

(22) Filed: Jun. 1, 2004

(65) Prior Publication Data
US 2005/0008957 A1 Jan. 13, 2005

(30) Foreign Application Priority Data

| | | | |
|---|---|---|---|
| Jun. 2, 2003 | (JP) | ..... | 2003-157204 |
| Jun. 11, 2003 | (JP) | ..... | 2003-166890 |
| Jun. 11, 2003 | (JP) | ..... | 2003-167080 |
| Jul. 3, 2003 | (JP) | ..... | 2003-191403 |

(51) Int. Cl.
*G03G 15/02* (2006.01)

(52) U.S. Cl. ..... 430/58.85; 430/58.7; 430/58.75; 430/125.3; 399/159

(58) Field of Classification Search ..... 430/58.85, 430/58.7, 58.75, 126
See application file for complete search history.

(56) References Cited

U.S. PATENT DOCUMENTS 3,873,312 A 3/1975 Contois et al.
(Continued)

FOREIGN PATENT DOCUMENTS

EP 1 205 808 5/2002
(Continued)

OTHER PUBLICATIONS

U.S. Appl. No. 11/500,352, filed Aug. 8, 2006, Toshine, et al.
(Continued)

*Primary Examiner*—Mark A. Chapman
(74) *Attorney, Agent, or Firm*—Oblon, Spivak, McClelland, Maier & Neustadt, P.C.

(57) ABSTRACT

A photoreceptor including an electroconductive substrate; a photosensitive layer; and optionally a protective layer, wherein an outermost layer thereof includes a filler, an organic compound having an acid value of from 10 to 700 mg KOH/g and at least one compound selected from the group consisting of compounds having the following formulae (1) and (2):

(1)

(2)

wherein $R^1$ ($R^3$) and $R^2$ ($R^4$) independently represent a substituted or an unsubstituted aromatic hydrocarbon group, or a substituted or an unsubstituted alkyl group, and optionally share bond connectivity to form a heterocyclic group including a nitrogen atom; $Ar^1$ ($Ar^3$) and $Ar^2$ ($Ar^4$) independently represent a substituted or a unsubstituted aromatic ring group; k (K) and m (M) independently represent 0 or an integer of from 1 to 3, wherein k (K) and m (M) are not 0 at the same time; and n (n') represents an integer of from 1 to 3.

23 Claims, 6 Drawing Sheets

U.S. PATENT DOCUMENTS 4,390,608 A 6/1983 Hashimoto et al.
5,059,708 A 10/1991 Aruga et al.
5,072,061 A 12/1991 Sasaki et al.
5,153,073 A 10/1992 Ohnuma et al.
5,158,850 A 10/1992 Sasaki et al.
5,248,826 A 9/1993 Sasaki et al.
5,250,377 A 10/1993 Shimada et al.
5,268,246 A 12/1993 Aruga et al.
5,286,588 A 2/1994 Suzuki
5,312,707 A 5/1994 Ota et al.
5,319,069 A 6/1994 Sasaki et al.
5,334,470 A 8/1994 Shimada et al.
5,344,985 A 9/1994 Tanaka et al.
5,356,742 A 10/1994 Shimada et al.
5,403,950 A 4/1995 Shimada et al.
5,420,332 A 5/1995 Shimada et al.
5,434,028 A 7/1995 Shimada et al.
5,436,100 A 7/1995 Shimada et al.
5,457,232 A 10/1995 Tanaka et al.
5,459,275 A 10/1995 Tanaka et al.
5,475,137 A 12/1995 Shimada et al.
5,480,753 A 1/1996 Shimada et al.
5,489,495 A 2/1996 Anzai et al.
5,547,792 A 8/1996 Shimada et al.
5,561,016 A 10/1996 Suzuki et al.
5,569,800 A 10/1996 Aruga et al.
5,576,132 A 11/1996 Tanaka et al.
5,578,405 A 11/1996 Ikegami et al.
5,587,516 A 12/1996 Tanaka et al.
5,599,995 A 2/1997 Tanaka et al.
5,604,065 A 2/1997 Shimada et al.
5,616,805 A 4/1997 Tanaka et al.
5,631,404 A 5/1997 Anzai et al.
5,641,598 A 6/1997 Tanaka et al.
5,663,407 A 9/1997 Shimada et al.
5,665,500 A 9/1997 Suzuki
5,672,728 A 9/1997 Tanaka et al.
5,672,756 A 9/1997 Shimada et al.
5,677,096 A 10/1997 Suzuki
5,702,833 A 12/1997 Nagai et al.
5,702,855 A 12/1997 Ikegami et al.
5,709,959 A 1/1998 Adachi et al.
5,723,243 A 3/1998 Sasaki et al.
5,747,204 A 5/1998 Anzai et al.
5,789,128 A 8/1998 Adachi et al.
5,808,155 A 9/1998 Shimada et al.
5,830,980 A 11/1998 Anzai et al.
5,840,454 A 11/1998 Nagai et al.
5,846,680 A 12/1998 Adachi et al.
5,853,935 A 12/1998 Suzuki et al.
5,871,876 A 2/1999 Ikuno et al.
5,910,561 A 6/1999 Adachi et al.
5,928,828 A 7/1999 Suzuki
5,932,362 A 8/1999 Nagai et al.
5,942,363 A 8/1999 Tanaka et al.
5,981,124 A 11/1999 Shimada et al.
6,018,014 A 1/2000 Nagai et al.
6,026,262 A 2/2000 Kinoshita et al.
6,027,846 A 2/2000 Shimada et al.
6,030,733 A 2/2000 Kami et al.
6,030,736 A 2/2000 Ikegami et al.
6,066,757 A 5/2000 Tanaka et al.
6,069,224 A 5/2000 Adachi et al.
6,093,784 A 7/2000 Tamura et al.
6,103,435 A 8/2000 Shimada et al.
6,132,914 A 10/2000 Shimada
6,136,483 A 10/2000 Suzuki et al.
6,151,468 A 11/2000 Kami et al.
6,177,220 B1 1/2001 Watanabe et al.
6,184,362 B1 2/2001 Shimada et al.
6,191,249 B1 2/2001 Tanaka et al.
6,271,356 B1 8/2001 Shimada et al.
6,313,288 B1 11/2001 Shimada et al.
6,316,577 B1 11/2001 Shimada et al.
6,326,112 B1 12/2001 Tamura et al.
6,333,439 B1 12/2001 Shimada
6,448,384 B1 9/2002 Shimada
6,465,648 B1 10/2002 Tadokoro et al.
6,492,079 B2 12/2002 Shimada et al.
6,524,761 B2 2/2003 Shimada et al.
6,544,701 B2 4/2003 Tadokoro et al.
6,548,216 B2 4/2003 Kawamura et al.
6,573,016 B2 6/2003 Kami et al.
6,596,449 B2 7/2003 Shimada et al.
6,641,964 B2 11/2003 Ikuno et al.
6,653,033 B1 11/2003 Kami et al.
2002/0181971 A1 12/2002 Mochizuki et al.

FOREIGN PATENT DOCUMENTS

JP 64-566 1/1989
JP 64-25748 1/1989
JP 1-312549 12/1989
JP 2-82255 3/1990
JP 2-282262 11/1990
JP 04-281461 10/1992
JP 6-1973 1/1994
JP 2000-066434 3/2000
JP 2001-281892 10/2001
JP 2002-169318 6/2002
JP 2002-207308 7/2002
JP 2002-278269 9/2002
JP 2002-351113 12/2002
JP 2002-351115 12/2002
JP 2003-149849 5/2003

OTHER PUBLICATIONS

U.S. Appl. No. 11/367,786, filed Mar. 6, 2006, Ohta, et al.
U.S. Appl. No. 11/366,469, filed Mar. 3, 2006, Sugino, et al.
U.S. Appl. No. 11/332,545, filed Jan. 17, 2006, Tamoto, et al.
U.S. Appl. No. 11/317,302, filed Dec. 27, 2005, Takada, et al.
U.S. Appl. No. 11/229,749, filed Sep. 20, 2005, Ohshima, et al.
U.S. Appl. No. 11/219,886, filed Sep. 7, 2005, Niimi, et al.
U.S. Appl. No. 11/190,856, Jul. 28, 2005, Tanaka, et al.
U.S. Appl. No. 11/218,657, filed Sep. 6, 2005, Suzuki, et al.
U.S. Appl. No. 11/172,989, filed Jul. 5, 2005, Li, et al.
U.S. Appl. No. 11/166,853, filed Jun. 27, 2005, Ohshima, et al.
U.S. Appl. No. 11/165,279, filed Jun. 24, 2005, Ohshima, et al.
U.S. Appl. No. 11/110,937, filed Apr. 21, 2005, Ohshima, et al.
U.S. Appl. No. 11/068,180, filed Mar. 1, 2005, Tamoto, et al.
U.S. Appl. No. 11/006,643, Dec. 8, 2004, Takada, et al.
U.S. Appl. No. 11/030,307, Jan. 7, 2005, Kami, et al.
U.S. Appl. No. 10/667,410, filed Sep. 23, 2003, Ikegami, et al.
U.S. Appl. No. 10/405,843, filed Apr. 3, 2003, Tamoto, et al.
U.S. Appl. No. 10/460,152, Jun. 13, 2003, Suzuki, et al.
U.S. Appl. No. 10/628,532, filed Jul. 29, 2003, Kurimoto, et al.
U.S. Appl. No. 10/612,146, filed Jul. 3, 2003, Mura, et al.
U.S. Appl. No. 10/349,960, filed Jan. 24, 2003, Yasutomi, et al.
U.S. Appl. No. 10/384,701, filed Mar. 11, 2003, Nohsho, et al.
U.S. Appl. No. 10/454,556, Jun. 5, 2003, Niimi.
U.S. Appl. No. 10/315,935, Dec. 11, 2002, Kurimoto, et al.
U.S. Appl. No. 10/384,662, Mar. 11, 2003, Sugino, et al.
U.S. Appl. No. 10/244,444, filed Sep. 17, 2002, Suzuki.
U.S. Appl. No. 10/260,275, filed Oct. 1, 2002, Yasutomi, et al.
U.S. Appl. No. 10/268,830, filed Oct. 11, 2002, Nakazato, et al.
U.S. Appl. No. 10/235,961, Sep. 6, 2002, Ikegami, et al.
U.S. Appl. No. 10/175,799, filed Jun. 21, 2002, Li, et al.
U.S. Appl. No. 10/180,316, filed Jun. 27, 2002, Sugino, et al.
U.S. Appl. No. 10/135,548, filed May 1, 2002, Tamoto, et al.
U.S. Appl. No. 10/103,791, filed Mar. 25, 2002, Tamoto, et al.
U.S. Appl. No. 10/090,745, Mar. 6, 2002, Suzuki, et al.
U.S. Appl. No. 10/104,078, Mar. 25, 2002, Ikegami, et al.
U.S. Appl. No. 09/985,347, filed Nov. 2, 2001, Tamoto, et al.
U.S. Appl. No. 11/941,355, filed Nov. 16, 2007, Ikuno, et al.

U.S. Appl. No. 12/000,239, filed Dec. 11, 2007, Fujiwara, et al.
U.S. Appl. No. 11/852,708, filed Sep. 10, 2007, Tada, et al.
U.S. Appl. No. 11/850,394, filed Sep. 5, 2007, Toshine, et al.
U.S. Appl. No. 11/750,570, filed May 18, 2007, Ikuno, et al.
U.S. Appl. No. 11/692,682, filed Mar. 28, 2007, Mori, et al.
U.S. Appl. No. 11/684,520, filed Mar. 9, 2007, Toshine, et al.
U.S. Appl. No. 11/695,750, filed Apr. 3, 2007, Takada, et al.
U.S. Appl. No. 11/621,805, filed Jan. 10, 2007, Suzuki, et al.
U.S. Appl. No. 11/561,983, filed Nov. 21, 2006, Sugino, et al.
U.S. Appl. No. 11/563,710, filed Nov. 28, 2006, Inaba, et al.
U.S. Appl. No. 11/616,523, filed Dec. 27, 2006, Fujiwara, et al.

PHOTORECEPTOR, IMAGE FORMING METHOD AND IMAGE FORMING APPARATUS USING THE PHOTORECEPTOR, PROCESS CARTRIDGE USING THE PHOTORECEPTOR AND COATING LIQUID FOR THE PHOTORECEPTOR

BACKGROUND OF THE INVENTION

1. Field of the Invention

The present invention relates to an electrophotographic photoreceptor, an image forming method and an image forming apparatus using the electrophotographic photoreceptor, a process cartridge for image forming apparatus using the electrophotographic photoreceptor, and a coating liquid for the electrophotographic photoreceptor.

2. Discussion of the Background

Recently, information-processing systems using an electrophotographic method are making a remarkable progress. In particular, laser printers and digital copiers which record data with light by changing the data into digital signals make remarkable improvements in their printing qualities and reliabilities. Further, technologies used in these printers and copiers are applied to laser printers and digital copiers capable of printing full-color images with high-speed printing technologies. Because of these reasons, photoreceptors are required both to produce high-quality images and to have high durability.

Photoreceptors using organic photosensitive materials are widely used for these laser printers and digital copiers due to their cost, productivity and non-polluting properties. As the organic electrophotographic photoreceptors, the photoreceptors including photoconductive resin typified by poly-N-vinylcarbazole (PVK); charge transfer complex type photoreceptors typified by PVK-TNF (2,4,7-trinitrofluorenon); pigment dispersion type photoreceptors typified by phthalocyanine-binder; and functionally-separated photoreceptors typified by combinations of a charge generation material (CGM) with a charge transport material (CTM) are known.

Among these various photoreceptors, the photoreceptors using organic photosensitive materials are mostly functionally-separated photoreceptors because of having good sensitivity and durability, wherein the charge generation materials and charge transport materials can individually be designed at a molecular level.

A mechanism to form an electrostatic latent image in the multi-layered photoreceptor is as follows:

the photoreceptor is charged and irradiated with light;

the light passes through the charge transport layer (CTL) and is absorbed by the CGM in the charge generation layer (CGL) to generate a charge;

the charge is injected into the CTL at an interface of the CGL and the CTL;

and the charge moves in the CTL by an electric field and neutralizes the charge on the surface of the photoreceptor to form an electrostatic latent image.

However, the photosensitive layers of the organic photoreceptor are easily abraded due to repeated use, and therefore potential and photosensitivity of the photoreceptor tend to deteriorate, resulting in background fouling due to a scratch on the surface thereof and deterioration of density and quality of the resultant images. Therefore, abrasion resistance of the organic photoreceptor has been an important subject. Further, recently, in accordance with speeding up of the printing speed and downsizing of an image forming apparatus, the photoreceptor has to have a smaller diameter, and durability thereof becomes a more important subject.

As a method of realizing high durability of a photoreceptor, methods of forming a protective layer on the outermost surface of the photoreceptor and applying a lubricant thereto; hardening the protective layer; or including a filer therein are widely known. In particular, the method of including a filler in a protective layer is one of effective methods to improve durability of a photoreceptor. However, when a high-insulative filler is included in a protective layer, an electric resistance thereof increases and residual potential remarkably increases. The increase of residual potential is largely caused by the increase of electric resistance due to the filler and an increase of a charge trap site. On the other hand, when an electroconductive filler is used, electric resistance decreases and an influence of residual potential increase is relatively small, but so-called blurred images having fuzzy outlines occurred and an influence on image quality is large.

Therefore, the high-insulative is difficult to use and a low-insulative filler having relatively a small influence of residual potential is conventionally used, and means of equipping a drum heater heating a photoreceptor with an image forming apparatus is used against blurred images caused by the low-insulative filler. By heating a photoreceptor, blurred images can be prevented, however, a diameter of the photoreceptor has to be large so as to be equipped with the drum heater. Therefore, the drum heater cannot be applied to a photoreceptor having a small diameter which is now prevailing in accordance with downsizing of an electrophotographic apparatus, and high durability of a small-diameter photoreceptor is difficult. Further, since an apparatus has to be large to be equipped with the drum heater, the electric power consumption remarkably increases and it takes much time to start the apparatus up, which are of many remaining subjects.

On the other hand, the residual potential increase when the high insulative filler is used causes a high potential of a light portion in an apparatus, resulting in deterioration of image density and tone reproduction. In order to catch up this drawback, potential of a dark portion has to be increased and an electric intensity increases, resulting in not only defective images such as background fouling but also deterioration of a life of a photoreceptor.

As a method of preventing the increase of the residual potential, a method of using a photoconductive protective layer is disclosed (Japanese Patent publications Nos. 44-834, 43-16198 and 49-10258). However, since the protective layer absorbs light and amount of light reaching a photosensitive layer decreases, a problem that sensitivity of a photoreceptor deteriorates occurs, and an effect of the method is slight.

To the contrary, a method of including a metal or metal oxide having an average particle diameter not greater than 0.3 μm in a protective layer is disclosed (Japanese Laid-Open Patent Publication No. 57-30846), by which the protective layer substantially becomes transparent. This method slightly prevents the increase of residual potential, but the effect is insufficient and does not solve the problem. This is because the increase of residual potential when a filler is included in a protective layer is caused by a charge trap due to presence of the filer or dispersibility of the filler more than charge generation efficiency. Even when the filler has an average particle diameter not less than 0.3 μm, a protective layer has transparency if dispersibility of the filler is increased. In addition, even when the filler has an average particle diameter not greater than 0.3 μm, the transparency deteriorates if the filler is agglutinated.

A method of including a charge transport material with a filler in a protective layer is disclosed (Japanese Laid-Open Patent Publication No. 4-281461), by which the protective layer has mechanical strength and the increase of residual potential is prevented. The charge transport material is effectively included in the protective layer to improve charge mobility and to decrease the residual potential. However, if the significant increase of residual potential caused by the filler is due to increase of resistance or charge trap caused by presence of the filler, the method has a limit to improve charge mobility and prevent the increase of residual potential. Therefore, the thickness of the protective layer or the content of the filler has to be decreased, and the method does not satisfy required durability.

As other methods of preventing the increase of residual potential, a method of including a Lewis acid in a protective layer (Japanese Laid-Open Patent Publication No. 53-133444), a method of including an organic protonic acid in a protective layer (Japanese Laid-Open Patent Publication No. 55-157748), a method of including an electron acceptance material in a protective layer (Japanese Laid-Open Patent Publication No. 2-4275) and a method of including a wax having an acid vale not greater than 5 (mg KOH/g) in a protective layer (Japanese Laid-Open Patent Publication No. 2000-66434) are disclosed. These methods improve charge injection at an interface between a protective layer and a charge transport layer and form a resistant portion in the protective layer so that a charge can easily reach the surface. These methods decrease the residual potential, however, tend to cause blurred images and have a side effect of significantly affecting image quality. In addition, when an organic acid is included in a protective layer, dispersibility of the filler tends to deteriorate and the effect is insufficient, and the methods do not solve the problem.

In an electrophotographic photoreceptor including a filler for high durability, in order to realize high-quality images, not only the above-mentioned occurrence of blurred images and increase of residual potential are prevented but also it is important that a charge reaches a surface of the photoreceptor straight without being interrupted with the filler in the protective layer. This is largely influenced by dispersibility of the filler in a protective layer. When a charge injected into the protective layer from a charge transport layer transfers to the surface, the charge is easily interrupted with the filler if the filler is agglutinated, resulting in dispersion of a dot formed of a toner and large deterioration of image resolution. In addition, when light transmittance deteriorates because writing light is scattered by the filler, the image resolution is damaged as well. An influence on the light transmittance also has a close relationship with dispersibility of the filler. Further, dispersibility of the filler largely influences abrasion resistance. When the filler is firmly agglutinated and not well dispersed, the abrasion resistance largely deteriorates. Therefore, in an electrophotographic photoreceptor including a filler for high durability, in order to realize high-quality images, not only the occurrence of blurred images and increase of residual potential are prevented but also it is important to increase dispersibility of the filler in the protective layer.

However, effective means to solve the problems at the same time are not found. When a filler is included in the outermost surface of a photoreceptor, influences of the blurred images and increase of residual potential strongly appear and problems to attain high-quality images still remain. Further, in order to decrease the influences, a drum heater has to be equipped with an apparatus. High durability of a photoreceptor having a small diameter, which requires durability most, is not realized. In addition, this is a large bottleneck against downsizing the apparatus and decreasing the electric power consumption.

Then, the present inventors suggested in EP Patent Application Publication No. 1205808 an electrophotographic photoreceptor, on the outermost surface of which a layer including a filler, a binder resin and an organic compound having an acid value of from 10 to 700 mg KOH/g is formed.

However, the electrophotographic photoreceptor produces lower quality images due a low resistance of the outermost surface although an increase of residual potential can be prevented and a dispersibility of the filler can be improved.

Because of these reasons, a need exists for an electrophotographic photoreceptor having high durability, preventing an increase of residual potential or deteriorated images due to occurrence of blurred images and stably producing high-quality images against repeated use for long periods.

SUMMARY OF THE INVENTION

Accordingly, an object of the present invention is to provide an electrophotographic photoreceptor having high durability, preventing an increase of residual potential or deteriorated images due to occurrence of blurred images and stably producing high-quality images against repeated use for long periods.

Another object of the present invention is to provide an electrophotographic method, an electrophotographic apparatus and a process cartridge using the photoreceptor, which do not need to exchange the photoreceptor, realize downsizing of the apparatus in accordance with high-speed printing and smaller diameter of the photoreceptor and stably produce high-quality images.

Still another object of the present invention is to provide a coating liquid having a good temporal storage stability for the photoreceptor.

Briefly these objects and other objects of the present invention as hereinafter will become more readily apparent can be attained by a photoreceptor including an electroconductive substrate; a photosensitive layer located overlying the electroconductive substrate; and optionally a protective layer located overlying the photosensitive layer, wherein an outermost layer of the photoreceptor comprises a filler, an organic compound having an acid value of from 10 to 700 mg KOH/g and at least one compound selected from the group consisting of compounds having the following formula (1):

(1)

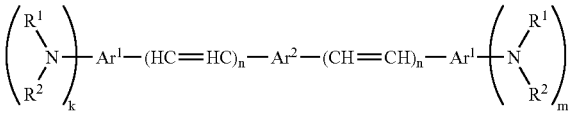

wherein $R^1$ and $R^2$ independently represent a substituted or an unsubstituted aromatic hydrocarbon group, or a substituted or an unsubstituted alkyl group, and optionally share bond connectivity to form a heterocyclic group including a nitrogen atom; $Ar^1$ and $Ar^2$ independently represent a substituted or a unsubstituted aromatic ring group; k and m independently represent 0 or an integer of from 1 to 3, wherein k and m are not 0 at the same time; and n represents an integer of from 1 to 3, and compounds having the following formula (2):

(2)

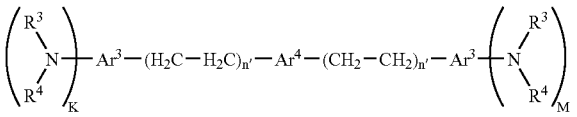

wherein $R^3$ and $R^4$ independently represent a substituted or an unsubstituted aromatic hydrocarbon group, or a substituted or an unsubstituted alkyl group, and optionally share bond connectivity to form a heterocyclic group including a nitrogen atom; $Ar^3$and $Ar^4$ independently represent a substituted or a unsubstituted aromatic ring group; K and M independently represent 0 or an integer of from 1 to 3, wherein K and M are not 0 at the same time; and n' represents an integer of from 1 to 3.

Further, a coating liquid forming the layer located overlying the photosensitive layer preferably includes an antioxidant to improve a temporal storage stability of the coating liquid.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
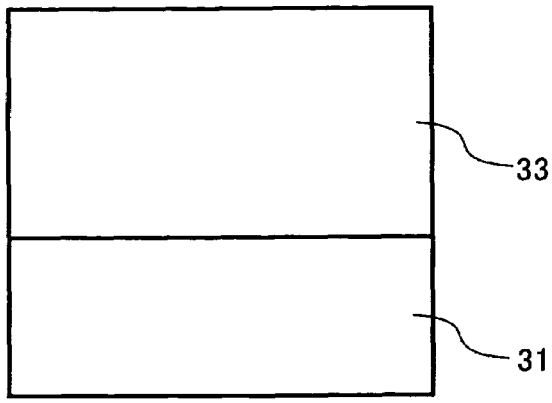
FIG. 1 is a cross-sectional view of an embodiment of layers of the electrophotographic photoreceptor of the present invention.

Generally, the present invention provides an electrophotographic photoreceptor having high durability and producing high-quality images, and stably producing the high-quality images even after repeatedly used. In addition, the present invention provides a coating liquid for forming a layer of a photoreceptor, which has good storage stability, and a method of producing a photoreceptor using the coating liquid. Further, the present invention provides an electrophotographic image forming method, an electrophotographic image forming apparatus and a process cartridge for an electrophotographic image forming apparatus using the electrophotographic photoreceptor.

In order to realize high durability of an electrophotographic photoreceptor, it is known that formation of a protective layer including a filler on the outermost surface of the photoreceptor is effective. However, the electrophotographic photoreceptor having high durability, the outermost surface of which includes a filler cannot avoid an influence on the resultant images such as occurrence of blurred images, increase of residual potential and deterioration of image resolution as an adverse effect. It is difficult to have it both ways of high durability and high quality images. This is because, the higher the resistance, the better to prevent the occurrence of blurred images, and the lower the resistance, the better to prevent the increase of residual potential, which makes it difficult to solve the problem due to the mutual trade-off relationship.

The present inventors discovered that the increase of the residual potential due to the filler can be prevented by including an organic compound having an acid value of from 10 to 700 mg KOH/g. However, they also discovered that the residual potential or the influence on the resultant images is not only caused by properties of the filler but also is largely caused by dispersibility thereof. Namely, when the filler is free from agglutination and has good dispersibility, a charge injected into the protective layer easily reaches a surface of the protective layer. Therefore, not only the increase of residual potential can be prevented, but also dot reproducibility formed by a toner has more high-fidelity, resulting in high resolution images. To the contrary, when the filler is in an extreme agglutinated status, the charge is interrupted with the filler and the charge transport progressivity deteriorates. Therefore, not only the image resolution deteriorates, but also the charge is easily trapped, resulting in the increase of residual potential.

Inorganic (hydrophilic) filler having a low affinity with an organic solvent and a binder resin is easily agglutinated. The affinity of the inorganic filler with the organic solvent and binder resin can be increased by including the organic compound having an acid value of from 10 to 700 (mg KOH/g) of the present invention, resulting in increase of dispersibility of the filler. In addition, the acid moderately decreases resistance of layer. This synergy effect not only decreases the residual potential but also improves dispersibility of the filler. Therefore, a dot formed of a toner does not scatter and high quality images having higher dot reproducibility can be produced.

Further, an improved dispersibility of the filler effectively and largely exerts an effect on high quality images such as improvement of light transmittance of the outermost surface layer and prevention of image density irregularities, and additionally has many advantages such as improvement of abrasion resistance and prevention of coated defect of the outermost surface layer. In addition, a protective layer coating liquid having high stability and a long life without an agglomeration of the filler as time passes can be obtained, and consequently an electrophotographic photoreceptor having high durability and producing high quality images can be obtained for long periods.

An oxide gas such as ozone and NOx tends to be absorbed to the organic compound having an acid value of from 10 to 700 (mg KOH/g) because of its chemical constitution, which causes a low surface resistivity of the outermost surface, resulting in problems such as distorted images.

In the present invention, such problems can be solved by including a compound having the above-mentioned formula (e) (1) and/or (2) in a outermost surface layer of an electrophotographic photoreceptor.

Hereinafter, the electrophotographic photoreceptor of the present invention will be explained, referring to the drawings.

The electrophotographic photoreceptor of the present invention includes an electroconductive substrate and at least a photosensitive layer on the electroconductive substrate, and the outermost layer thereof includes a filler. The outermost layer has two constitutional embodiments. A first embodiment has the outermost layer in its photosensitive layer, and a second embodiment has a protective layer as the outermost layer. The first and second embodiments will specifically be explained using FIGS. 1 to 5.

FIG. 1 is a cross-sectional view of an embodiment of layers of the electrophotographic photoreceptor of the present invention, wherein a photosensitive layer 33 including a charge generation material and a charge transport material as main components is formed on an electroconductive substrate 31. This belongs to the first embodiment, and the photosensitive layer 33 is the outermost layer and includes a filler, etc.

Figure 2:
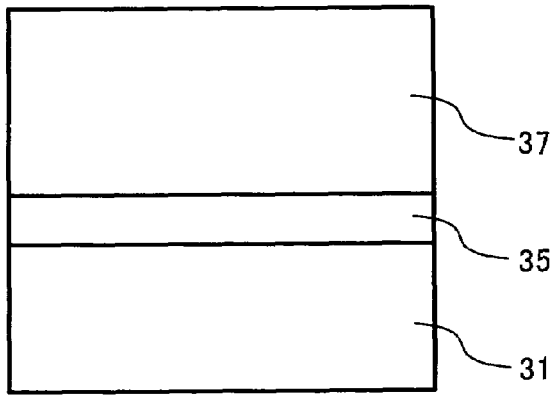
FIG. 2 is a cross-sectional view of another embodiment of layers of the electrophotographic photoreceptor of the present invention.

FIG. 2 is a cross-sectional view of another embodiment of layers of the electrophotographic photoreceptor of the present invention, wherein a charge generation layer 35 including a charge generation material as a main component and a charge transport layer 37 including a charge transport material as a main component are layered on an electroconductive substrate 31. This belongs to the first embodiment, and the charge transport layer 37 is the outermost layer (an outermost layer of a photosensitive layer) and includes a filler, etc.

Figure 3:
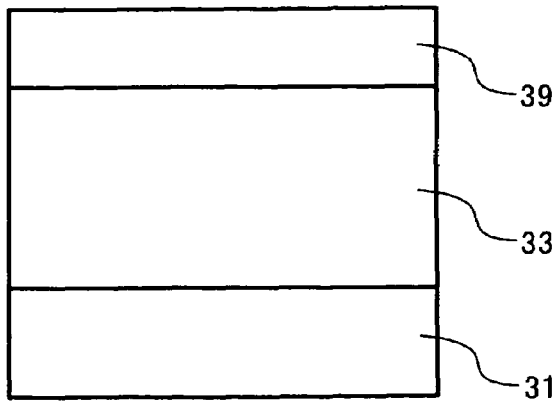
FIG. 3 is a cross-sectional view of a third embodiment of layers of the electrophotographic photoreceptor of the present invention.

FIG. 3 is a cross-sectional view of a third embodiment of layers of the electrophotographic photoreceptor of the present invention, wherein a photosensitive layer 33 including a charge generation material and a charge transport material as main components is formed on an electroconductive substrate 31, and further a protective layer 39 is formed on a surface of the photosensitive layer. This belongs to the second embodiment, and the protective layer 39 is the outermost layer and includes a filler, etc.

Figure 4:
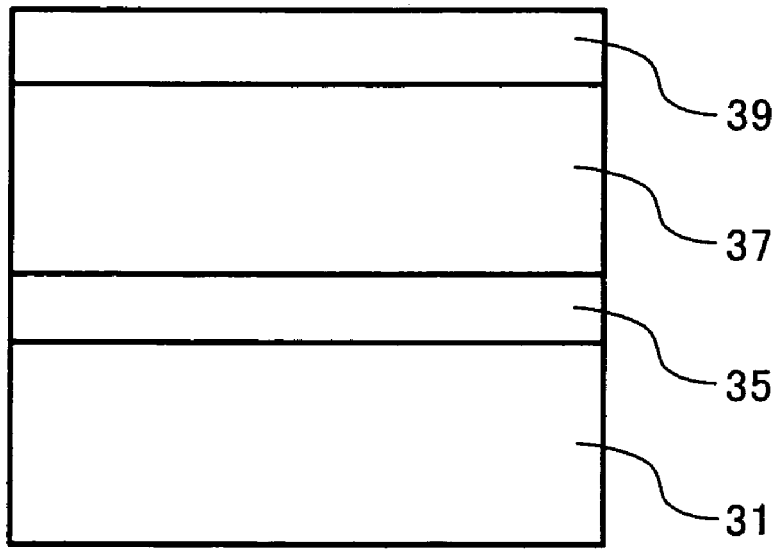
FIG. 4 is a cross-sectional view of a fourth embodiment of layers of the electrophotographic photoreceptor of the present invention.

FIG. 4 is a cross-sectional view of a fourth embodiment of layers of the electrophotographic photoreceptor of the present invention, wherein a charge generation layer 35 includes a charge generation material as a main component and a charge transport layer 37 including a charge transport material as a main component are layered on an electroconductive substrate 31, and further a protective layer 39 is formed on a surface of the charge transport layer. This belongs to the second embodiment, and the protective layer 39 is the outermost layer and includes a filler, etc.

Figure 5:
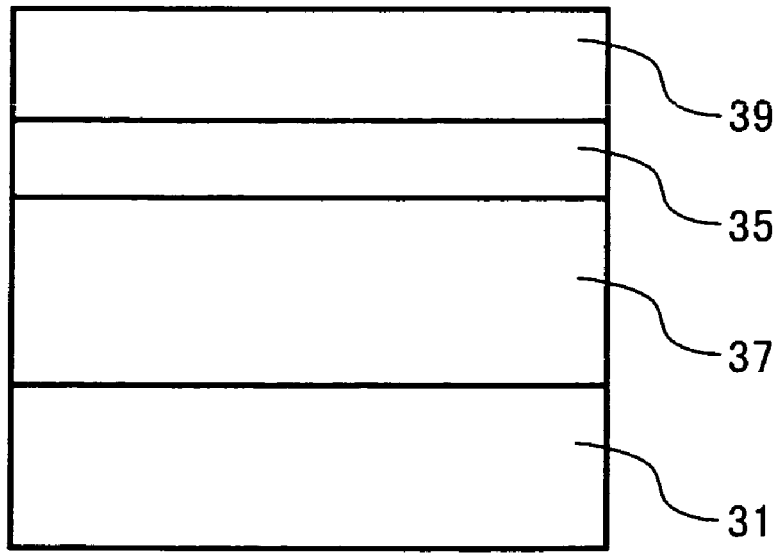
FIG. 5 is a cross-sectional view of a fifth embodiment of layers of the electrophotographic photoreceptor of the present invention.

FIG. 5 is a cross-sectional view of a fifth embodiment of layers of the electrophotographic photoreceptor of the present invention, wherein a charge transport layer 37 including a charge transport material as a main component and a charge generation layer 35 including a charge generation material as a main component are layered on an electroconductive substrate 31, and further a protective layer 39 is formed on a surface of the charge generation layer. This belongs to the second embodiment, and the protective layer 39 is the outermost layer and includes a filler, etc.

Next, respective layers forming the photoreceptor of the present invention will be explained.

Suitable materials for use as the electroconductive substrate 31 include materials having a volume resistance not greater than $10^{10}$ Ω·cm. Specific examples of such materials include plastic cylinders, plastic films or paper sheets, on the surface of which a metal such as aluminum, nickel, chromium, nichrome, copper, gold, silver, platinum and the like, or a metal oxide such as tin oxides, indium oxides and the like, is deposited or sputtered. In addition, a plate of a metal such as aluminum, aluminum alloys, nickel and stainless steel and a metal cylinder, which is prepared by tubing a metal such as the metals mentioned above by a method such as impact ironing or direct ironing, and then treating the surface of the tube by cutting, super finishing, polishing and the like treatments, can also be used as the substrate. Further, endless belts of a metal such as nickel and stainless steel, which have been disclosed in Japanese Laid-Open Patent Publication No. 52-36016, can also be used as the substrate 31.

Furthermore, substrates, in which a coating liquid including a binder resin and an electroconductive powder is coated on the supporters mentioned above, can be used as the substrate 31. Specific examples of such an electroconductive powder include carbon black, acetylene black, powders of metals such as aluminum, nickel, iron, Nichrome, copper, zinc, silver and the like, and metal oxides such as electroconductive tin oxides, ITO and the like. Specific examples of the binder resin include known thermoplastic resins, thermosetting resins and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like resins. Such an electroconductive layer can be formed by coating a coating liquid in which an electroconductive powder and a binder resin are dispersed in a solvent such as tetrahydrofuran, dichloromethane, methyl ethyl ketone, toluene and the like solvent, and then drying the coated liquid.

In addition, substrates, in which an electroconductive resin film is formed on a surface of a cylindrical substrate using a heat-shrinkable resin tube which is made of a combination of a resin such as polyvinyl chloride, polypropylene, polyesters, polyvinylidene chloride, polyethylene, chlorinated rubber and fluorine-containing resins, with an electroconductive material, can also be preferably used as the substrate 31.

Next, the photosensitive layer will be explained. The photosensitive layer may be a single-layer (FIGS. 1 and 3) or a multi-layer (FIGS. 2, 4 and 5). At first, the multi-layered photosensitive layer including the charge generation layer 35 and the charge transport layer 37 will be explained for explanation convenience.

The charge generation layer 35 includes a charge generation material as a main component. In the charge generation layer 35, known charge generation materials can be used. Specific examples of such charge generation materials include monoazo pigments, disazo pigments, trisazo pigments, perylene pigments, perynone pigments, quinacridone pigments, quinone type condensed polycyclic compounds, squaric acid type dyes, other phthalocyanine pigments, naphthalocyanine pigments, azulenium salt type dyes, and the like pigments and dyes. These charge generation materials can be used alone or in combination.

The charge generation layer 35 can be prepared by dispersing a charge generation material in a proper solvent optionally together with a binder resin using a ball mill, an attritor, a sand mill or a supersonic disperser, coating the coating liquid on an electroconductive substrate and then drying the coated liquid. The binder resin can be included in the coating liquid either before or after dispersion.

Suitable binder resins optionally for use in the charge generation layer 35 include polyamides, polyurethanes, epoxy resins, polyketones, polycarbonates, silicone resins, acrylic resins, polyvinyl butyral, polyvinyl formal, polyvinyl ketones, polystyrene, polysulfone, poly-N-vinylcarbazole, polyacrylamide, polyvinyl benzal, polyesters, phenoxy resins, vinyl chloride-vinyl acetate copolymers, polyvinyl acetate, polyphenylene oxide, polyamides, polyvinyl pyridine, cellulose resins, casein, polyvinyl alcohol, polyvinyl pyrrolidone, and the like resins. The charge generation layer 35 preferably includes the binder resin of from 0 to 500 parts by weight, and preferably from 10 to 300 parts by weight per 100 parts by weight of the charge generation material.

Suitable solvents for use in the coating liquid for preparing the charge generation layer 35 include isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, ligroin, and the like solvents. In particular, ketone type solvents, ester type solvents and ether type solvents are preferably used. These can be used alone or in combination.

The charge generation layer 35 includes a charge generation material, a solvent and a binder resin as main components, and may include any additives such as a sensitizer, a disperser, a detergent and a silicone oil.

The coating liquid can be coated by a coating method such as dip coating, spray coating, bead coating, nozzle coating, spinner coating and ring coating.

The charge generation layer 35 preferably has a thickness of from 0.01 to 5 μm, and more preferably from 0.1 to 2 μm.

The charge transport layer 37 includes a charge transport material as a main component. The charge transport layer 37 can be formed by dissolving or dispersing a charge transport material and a binder resin in a proper solvent coating the coating liquid on the charge generation layer and drying the coated liquid. Additives such as plasticizers, leveling agents and antioxidants can be optionally included in the coating liquid alone or in combination.

Charge transport materials are classified into positive-hole transport materials and electron transport materials.

Specific examples of the electron transport materials include electron accepting materials such as chloranil, bromanil, tetracyanoethylene, tetracyanoquinodimethane, 2,4,7-trinitro-9-fluorenon, 2,4,5,7-tetranitro-9-fluorenon, 2,4,5,7-tetanitroxanthone, 2,4,8-trinitrothioxanthone, 2,6,8-trinitro-4H-indeno[1,2-b]thiophene-4-one, 1,3,7-trinitrodibenzothiphene-5,5-dioxide, benzoquinone derivatives and the like.

Specific examples of the positive-hole transport materials include known materials such as poly-N-carbazole and its derivatives, poly-γ-carbazolylethylglutamate and its derivatives, pyrene-formaldehyde condensation products and their derivatives, polyvinyl pyrene, polyvinyl phenanthrene, polysilane, oxazole derivatives, oxadiazole derivatives, imidazole derivatives, monoarylamines, diarylamines, triarylamines, stilbene derivatives, α-phenyl stilbene derivatives, benzidinederivatives, diarylmethanederivatives, triarylmethane derivatives, 9-styrylanthracene derivatives, pyrazoline derivatives, divinyl benzene derivatives, hydrazone derivatives, indene derivatives, butadiene derivatives, pyrene derivatives, bisstilbene derivatives, enamine derivatives, and the like. These charge transport materials can be used alone or in combination.

Specific examples of the binder resin for use in the charge transport layer 37 include thermoplastic resins, thermosetting resins such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like.

The charge transport layer 37 preferably includes the charge transport material of from 20 to 300 parts by weight, and more preferably from 40 to 150 parts by weight per 100 parts by weight of the binder resin. The thickness of the charge transport layer is preferably not greater than 25 μm in view of resolution of the resultant images and response. The lower limit of the thickness is preferably not less than 5 μm, although it depends on the image forming system (particularly on the electric potential).

Suitable solvents for use in the coating liquid for forming the charge transport layer 37 include tetrahydrofuran, dioxane, toluene, dichloromethane, monochlorobenzene, dichloroethane, cyclohexanone, methyl ethyl ketone, acetone and the like solvents. These can be used alone in combination.

Further, when the charge transport layer 37 is an outermost surface layer, i.e., when a photoreceptor has the layer composition in FIG. 2, the charge transport layer 37 has a surface including a filler, at least an organic compound having an acid value of from 10 to 700 (mgKOH/g) and at least a compound selected from the group consisting of compounds having the following formula (1) or (2):

(1)

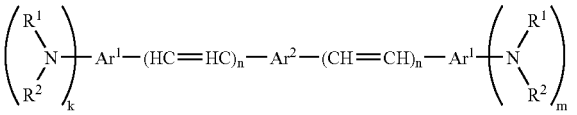

wherein $R^1$ and $R^2$ independently represent a substituted or an unsubstituted aromatic hydrocarbon group, or a substituted or an unsubstituted alkyl group, and optionally share bond connectivity to form a heterocyclic group including a nitrogen atom; $Ar^1$ and $Ar^2$ independently represent a substituted or a unsubstituted aromatic ring group; k and m independently represent 0 or an integer of from 1 to 3, wherein k and m are not 0 at the same time; and n represents an integer of from 1 to 3, (2)

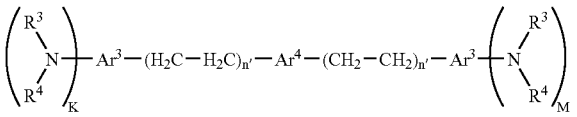

wherein $R^3$ and $R^4$ independently represent a substituted or an unsubstituted aromatic hydrocarbon group, or a substituted or an unsubstituted alkyl group, and optionally share bond connectivity to form a heterocyclic group including a nitrogen atom; $Ar^3$and $Ar^4$ independently represent a substituted or a unsubstituted aromatic ring group; K and M independently represent 0 or an integer of from 1 to 3, wherein K and M are not 0 at the same time; and n' represents an integer of from 1 to 3.

Next, in the layer composition in FIG. 2, the filler, the organic compound having an acid value of from 10 to 700 (mg KOH/g) and the compound selected from the group consisting of compounds having the formula (1) or (2) included in the charge transport layer 37 will be explained in this order.

The filler includes organic filler materials and inorganic filler materials.

Specific examples of the organic filler materials include a fluorocarbon resin powder such as polytetrafluoroethylene, a silicone resin powder and an α-carbon powder. Specific examples of inorganic filler materials include metallic powders such as copper, tin, aluminium and indium; metal oxides such as silica, tin oxide, zinc oxide, titanium oxide, alumina, zirconium oxide, indium oxide, stibium oxide, bismuth oxide, calcium oxide, zinc oxide doped with stibium and indium oxide doped with zinc; metal fluorides such as zinc fluoride, calcium fluoride and aluminium fluoride; and inorganic materials such as kalium titanate and boron nitride. Among these fillers, inorganic materials are advantageously used in terms of hardness of the filler to improve abrasion resistance of the resultant photoreceptor.

In the layer composition in FIG. 2, when the charge transport layer 37 includes the filler, the resultant photoreceptor has a high durability. However, the photoreceptor has adverse effects such as increase of a residual potential and production of blurred images. The present inventors discovered that a highly-insulative filler included in the charge transport layer 37 prevents the production of blurred images and at least an organic compound having an acid value of from 10 to 700 (mg KOH/g) included therein prevents the increase of residual potential. The residual potential can be reduced partly because an organic compound having an specific acid value is included in the charge transport layer 37 and partly because dispersibility of the filler is improved with the compound having an specific acid value. The improvement of dispersibility of a filler not only prevents the increase of residual potential but also prevents deterioration of writing light transmittance of the charge transport layer 37, occurrence of uneven image density, and further improves abrasion resistance and prevents coating defects of the resultant photoreceptor.

The above-mentioned highly-insulative filler is preferably used, and in particular, a filler having a pH not less than 5 or a dielectric constant not less than 5 such as titanium oxide, alumina, zinc oxide and zirconium oxide is preferably used. In addition, a filler having a pH not less than 5 or a dielectric constant not less than 5can be used alone, and a mixture of a filler having a pH not greater than 5 and a filler having a pH not less than 5 or a mixture of a filler having a dielectric constant not greater than 5 and a filler having a pH not less than 5 can be used. Among these fillers, an α-type alumina with a hexagonal close-packed structure having a high insulation, heat resistance and abrasion resistance is preferably used in terms of preventing blurred images and improving abrasion resistance.

Further, a surface treatment can be preferably made on these fillers with a surface treatment agent to improve dispersiblity thereof. Since low dispersiblity of the filler causes not only an increase of a residual potential but also low transparency and a defect of coating, and further low abrasion resistance, it is probable that the low dispersiblity of the filler will be a serious problem of preventing high durability and high quality images.

Any known surface treatment agents can be used, however, surface treatment agents which can maintain insulation of the filler are preferably used. For example, a titanate coupling agent, an aluminium coupling agent, a zircoaluminate coupling agent and a higher fatty acid or their mixtures with a silane coupling agent, $Al_2O_3$, $TiO_2$, $ZrO_2$, silicone and aluminium stearate or their mixtures are preferably used in terms of improving dispersibility of the filler and preventing blurred images. Although the silane coupling agent causes blurred images, a mixture thereof and the above-mentioned surface treatment agents occasionally prevent the blurred images. The content thereof depends on an average primary particle diameter of the filler, however, is preferably from 3to 3% by weight, and more preferably from 5 to 20% by weight. When less than 3% by weight, the filler is not well dispersed. When greater than 30% by weight, residual potential noticeably increases.

In addition, the filler preferably has an average primary particle diameter of from 0.01 to 0.5 μm in terms of light transmittance and abrasion resistance of the charge transport layer 37. When less than 0.01 μm, the abrasion resistance and the dispersibility deteriorates. When greater than 0.5 μm, the sedimentation of the filler is accelerated and the toner filming occurs.

The charge transport layer 37 preferably includes a filler of from 5 to 50% by weight, and more preferably from 10 to 40% by weight. When less than 5% by weight, the charge transport layer 37 does not have sufficient abrasion resistance. When greater than 50% by weight, the charge transport layer 37 does not have impaired transparency.

Next, the organic compound having an acid value of from 10 to 700 (mg KOH/g) included in the charge transport layer 37 will be explained.

The organic compound having an acid value of from 10 to 700 (mg KOH/g) included in the charge transport layer 37 can prevent the increase of residual potential caused by including a filler therein. The acid value is defined by a mg of potassium hydroxide required to neutralize a free fatty acid included in 1 g of the compound.

Any known organic compounds having an acid value of from 10 to 700 (mg KOH/g) such as organic fatty acids and resins having a high acid value can be used. However, since it is probable that a very low-molecular-weight organic acid such as a maleic acid, a citric acid, a tartaric acid and succinic acid or an acceptor largely decreases dispersibility of the filler, in some cases, it does not sufficiently decrease the residual potential. Therefore, in order to decrease residual potential of a photoreceptor and increase dispersibility of the filler, a low-molecular-weight polymer, a resin, a copolymer and their mixtures are preferably used. The organic compound preferably has a linear structure with few steric exclusions. In order to increase the dispersibility, both the filler and the binder resin have to have affinity. A material having a large steric exclusion decrease the affinity and deteriorates the dispersibility, resulting in occurrence of the above-mentioned many problems.

A polycarboxylic acid is preferably used as the organic compound having an acid value of from 10 to 700 (mg KOH/g). The polycarboxylic acid is an organic compound having two or more carboxyl groups or a compound having a structure including a carboxylic acid in its polymer or copolymer, and any organic compounds including a carboxylic acid or their derivatives such as polyester resins, acrylic resins, copolymers using an acrylic acid or a methacrylic acid and styrene acrylic copolymers can be used. These can be effectively used in combination. In some cases a mixture of these materials and an organic fatty acid increases dispersibility of the filler and decreases the residual potential.

In the present invention, the organic compound having an acid value of from 10 to 700 (mg KOH/g) is used, and an organic compound having an acid value of from 10 to 400 (mg KOH/g) is preferably used, an organic compound having an acid value of from30 to 400 (mg KOH/g) is more preferably used, and an organic compound having an acid value of from 30 to 200 (mg KOH/g) is most preferably used. When the acid value is higher than necessary, the resistance is decreased too much and blurred images are produced. When the acid value is too low, the content has to be increased and the residual potential is nor sufficiently decreased. In addition, the acid value of the material has to be determined based on a balance with the above-mentioned content. A higher acid value does not always reduce the residual potential effectively, and the reduction of residual potential largely depends upon a sorbability of the organic compound having an acid value of from 10 to 700 (mg KOH/g) to a filler. However, the acid value of the material does not have a direct influence on the reduction of residual potential, but the structure or molecular weight of the organic compound and dispersibility of the filler largely affects the reduction of residual potential.

A content of the organic compound having an acid value of from 10 to 700 (mg KOH/g) is determined by the acid value and a content of the filler. When two or more of the organic compound having an acid value of from 10 to 700 (mg KOH/g) are used, the following formula (a) is preferably satisfied:

$$0.1 \leqq \text{acid value equivalent } (A \times B/C) \leqq 20 \quad \text{(a)}$$

wherein A is a content of an organic compound having an acid value of from 10 to 700 (mg KOH/g); B is a content of another organic compound having an acid value of from 10 to 700 (mgKOH/g); and C is a content of the filler, and wherein A, B and C are preferably minimum quantities in a range satisfying the formula (a).

When the content of the organic compound having an acid value of from 10 to 700 (mg KOH/g) is more than necessary, the filler is not sufficiently dispersed adversely and blurred images are occasionally produced. When the content is too small, the filler is not sufficiently dispersed and the residual potential is not sufficiently reduced.

The content of the organic compound having an acid value of from 10 to 700 (mg KOH/g) is preferably from 0.01 to 50% by weight, and more preferably from 0.1 to 20% by weight per 100% by weight of the filler.

The organic compound such as a polycarboxylic acid not only decreases the residual potential but also occasionally prevents filming and improves coating adherence. However, when included in the charge transport layer 37 more than necessary, blurred images are produced and abrasion resistance of the resultant photoreceptor deteriorates occasionally.

The filler material included in the charge transport layer 37 can be dispersed with at least an organic solvent and the organic compound having an acid value of from 10 to 700 (mg KOH/g) using a conventional method such as a ball mill, an attritor, a sand mill and a supersonic. Among these methods, the ball mill with little interfusion of impurities from outside, which can increase a contact efficiency of the filler and the organic compound having an acid value of from 10 to 700 (mg KOH/g) is preferably used in terms of dispersibility. Any conventional media such as a zirconia, an alumina and an agate can be used, however, in particular, the alumina is preferably used in terms of dispersibility of the filler and reduction of the residual potential. The zirconia is largely abraded when dispersed and remarkably increases the residual potential. Further, the abraded powder is mixed, and the dispersibility largely deteriorates and sedimentaion of the filler is accelerated. To the contrary, when the alumina is used as the media, the alumina is abraded when dispersed, but the abraded amount is low and the abraded powder scarcely affect the residual potential. In addition, the abraded powder scarcely affect the dispersibility. Therefore, the alumina is preferably used as a media for use in the dispersion.

The organic compound having an acid value of from 10 to 700 (mgKOH/g) is preferably included in the coating liquid before dispersion because of preventing agglomeration and sedimentation of the filler and remarkably improving dispersibility of the filler. To the contrary, the binder resin and the charge transport material can be included in the coating liquid before dispersion. However, in this case, dispersibilitys lightly deteriorates, and therefore, the binder resin and the charge transport material is preferably included in the coating liquid after dispersion in a state of being dissolved in an organic solvent.

Next, the compounds having the formulae (1) and (2) included in the charge transport layer 37 in FIG. 2 will be explained.

The compounds having the formulae (1) and (2) are included in the charge transport layer 37 to prevent an adverse effect of the organic compound having an acid value of from 10 to 700 (mg KOH/g). The organic compound having an acid value of from 10 to 700 (mg KOH/g) tends to absorb an oxidized gas such as ozone and NOx caused by the usage conditions due to its chemical constitution. Occasionally, a surface resistivity of the outermost surface deteriorates and distorted images are produced. To solve this problem, the compounds having the formulae (1) to (2) are included in the charge transport layer 37. The reason why the compounds having the formulae (1) to (2) prevent the surface resistivity of the outermost surface from deteriorating and distorted images from being produced is not clarified yet. However, it can be supposed that a substituted amino group included in the compound effectively prevents generation of a radical material causing the oxidized gas. In addition, because the compounds having the formulae (1) to (2) have charge transportability, they do not become a trap for a charge transporter and deterioration of electric properties such as an increase of residual potential hardly occurs.

(1)

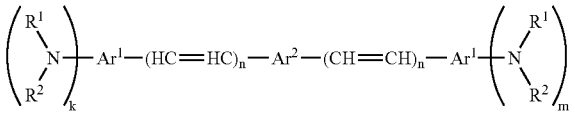

wherein $R_1$ and $R^2$ independently represent a substituted or an unsubstituted aromatic hydrocarbon group, or a substituted or an unsubstituted alkyl group, and optionally share bond connectivity to form a heterocyclic group including a nitrogen atom; $Ar^1$ and $Ar^2$ independently represent a substituted or a unsubstituted aromatic ring group; k and m independently represent 0 or an integer of from 1 to 3, wherein k and m are not 0 at the same time; and n represents an integer of from 1 to 3, (2)

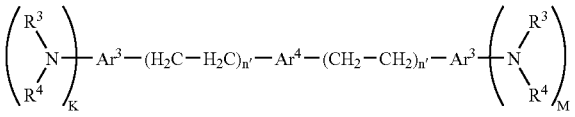

wherein $R^3$ and $R^4$ independently represent a substituted or an unsubstituted aromatic hydrocarbon group, or a substituted or an unsubstituted alkyl group, and optionally share bond connectivity to form a heterocyclic group including a nitrogen atom; $Ar^3$and $Ar^4$ independently represent a substituted or a unsubstituted aromatic ring group; K and M independently represent 0 or an integer of from 1 to 3, wherein K and M are not 0 at the same time; and n' represents an integer of from 1 to 3.

Specific examples of the aromatic hydrocarbon group represented by $R^1$ to $R^4$ include aromatic hydrocarbon ring groups such as benzene, naphthalene, anthracene and pyrene. Specific examples of the alkyl group represented by $R^1$ to $R^4$ include a methyl group, an ethyl group, a propyl group, a butyl group, a hexyl group, an undecanyl group, etc. and the alkyl group preferably has 1 to 4 carbon atoms. Specific examples of the aromatic ring group include an aromatic hydrocarbon ring group having 1 to 6 valences such as benzene, naphthalene, anthracene and pyrene; and an aromatic heterocyclic ring group having 1 to 6 valences such as pyridine, quinoline, thiophene, furan, oxazole, oxadiazole and carbazole. In addition, specific examples of their substituents include the above-mentioned specific examples of the alkyl group; an alkoxy group such as a methoxy group, an ethoxy group, a propoxy group and a butoxy group; a halogen atoms such as a fluorine atom, a chlorine atom, a bromine atom and an iodine atom; and an aromatic ring group. Further, specific examples of the heterocyclic ring group including a nitrogen atom, formed by a combination of $R^1$ and $R^2$ or $R^3$ and $R^4$, include a pyrrolidinyl group, a piperidinyl group, a pyrrolinyl group, etc. Specific example of the heterocyclic group including a nitrogen atom, formed by the two groups together include an aromatic heterocyclic ring group such as N-methylcarbazole, N-ethylcarbazole, N-phenylcarbazole, indole and quinoline.

Hereinafter, preferred embodiments of the compounds having the formula (1) or (2) are shown as follows, but are not limited thereto.

The compounds having the formula (1) and (2) include compounds disclosed in Japanese Patent Publication No.58-57739 and Japanese Patent No. 2529299, and the compound having the formula (1) can be prepared by a modified witting reaction or a witting reaction between an ester sulfonate compound or a triphenylphosphonium salt compound and an aldehyde compound. Further, the compound having the formula (2) can be prepared by denitrifying the compound having the formula (1).

TABLE 1

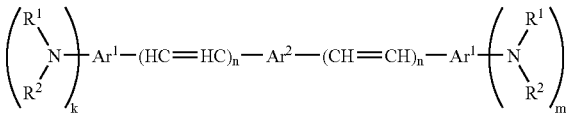

| Compound No. | Chemical Constitutional Formula |
|---|---|
| 1-1 | 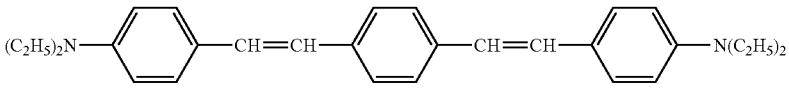 |
| 1-2 | 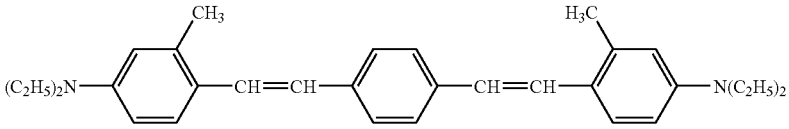 |

TABLE 1-continued
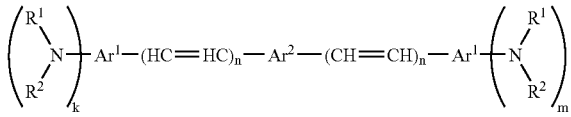
| Compound No. | Chemical Constitutional Formula |
|---|---|
| 1-3 | 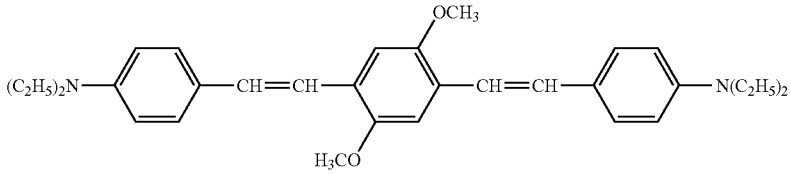 |
| 1-4 | 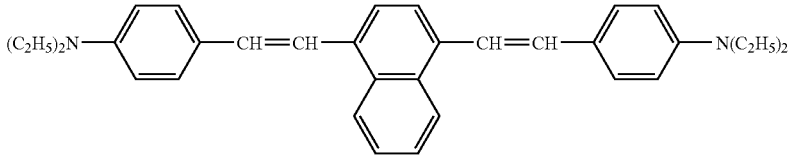 |
| 1-5 | 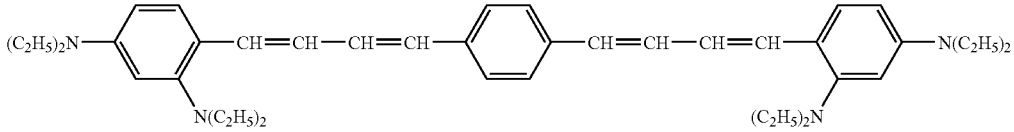 |
| 1-6 | 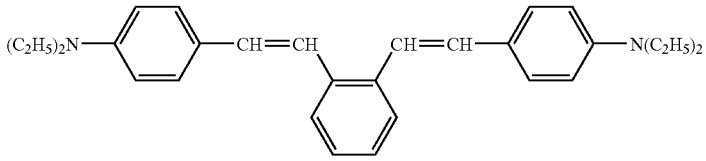 |
| 1-7 | 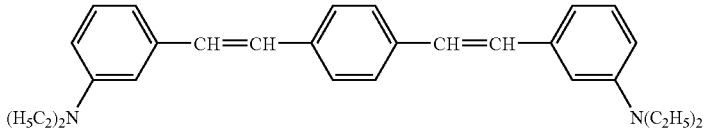 |
| 1-8 | 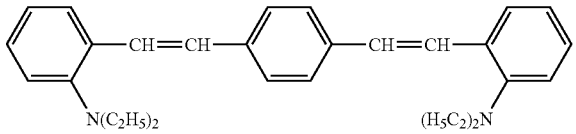 |
| 1-9 | 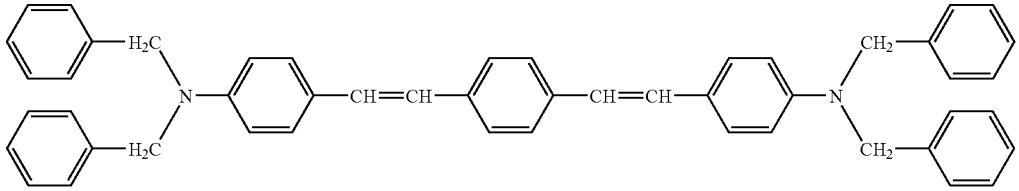 |
| 1-10 | 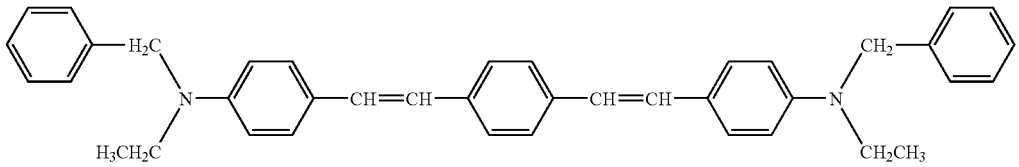 |

TABLE 1-continued
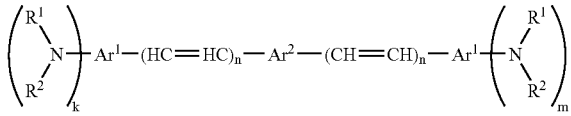
| Compound No. | Chemical Constitutional Formula |
|---|---|
| 1-11 | 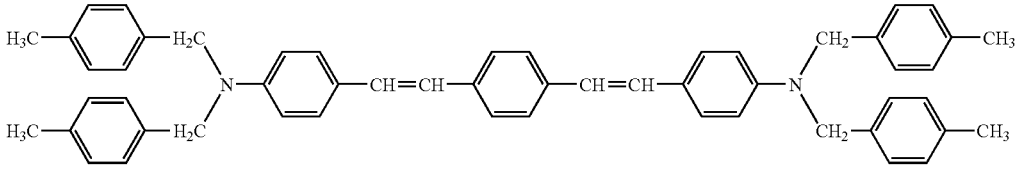 |
| 1-12 | 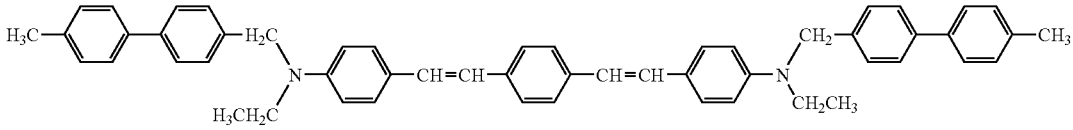 |
| 1-13 | 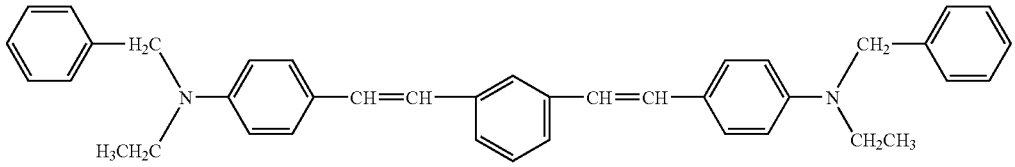 |
| 1-14 | 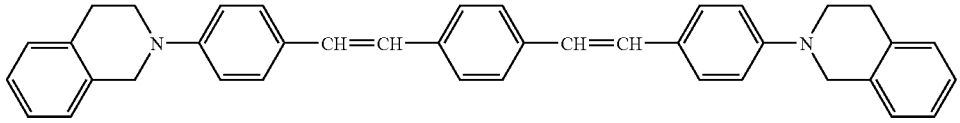 |
| 1-15 | 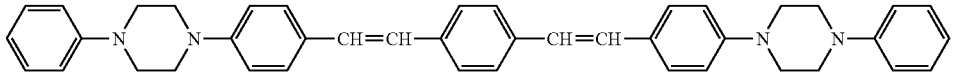 |
TABLE 2
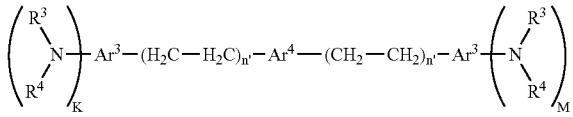
| Compound No. | Chemical Constitutional Formula |
|---|---|
| 2-1 | 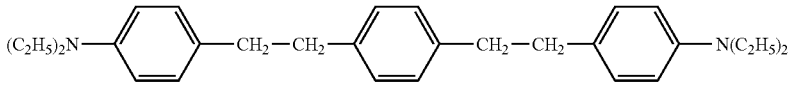 |
| 2-2 | 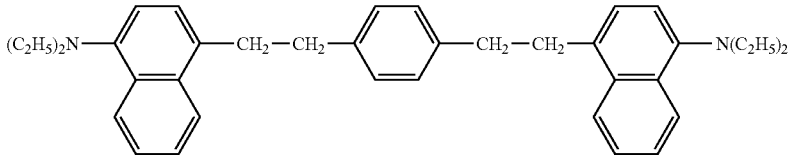 |

TABLE 2-continued
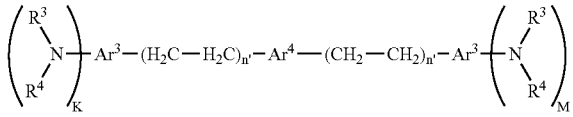
| Compound No. | Chemical Constitutional Formula |
|---|---|
| 2-3 | 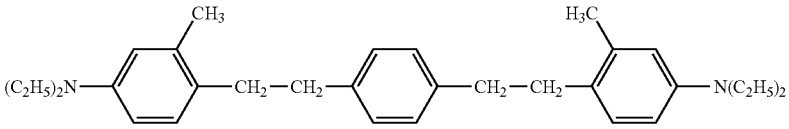 |
| 2-4 | 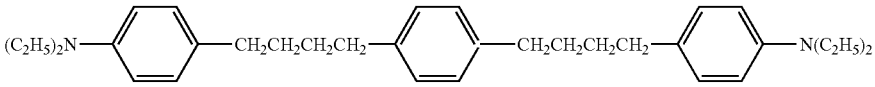 |
| 2-5 | 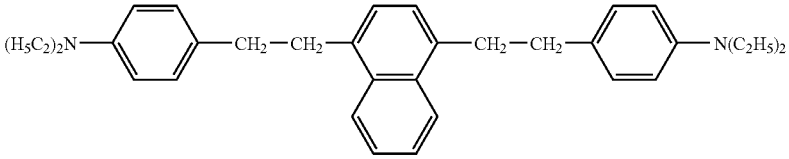 |
| 2-6 | 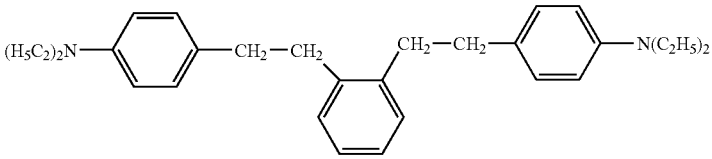 |
| 2-7 | 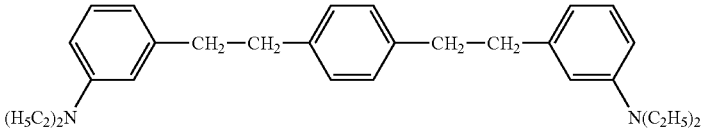 |
| 2-8 | 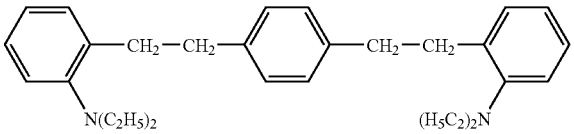 |
| 2-9 | 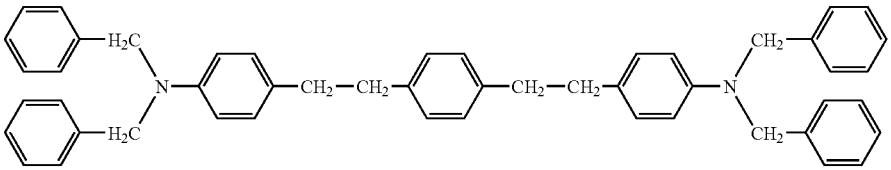 |
| 2-10 | 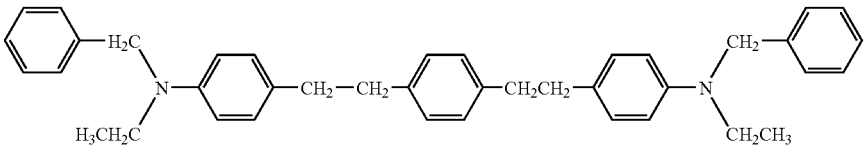 |
| 2-11 | 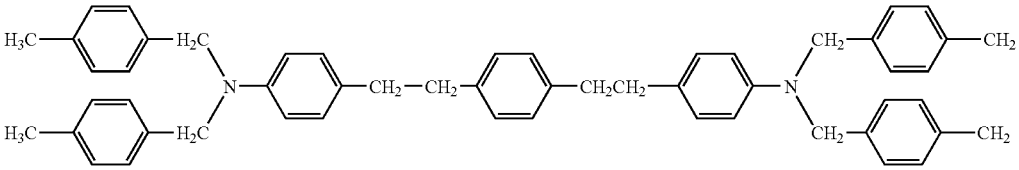 |

TABLE 2-continued

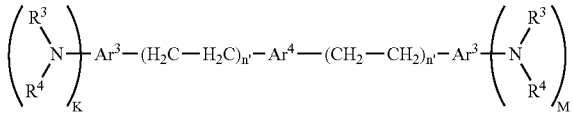

| Compound No. | Chemical Constitutional Formula |
|---|---|
| 2-12 | 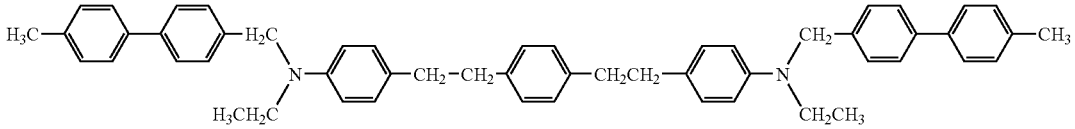 |
| 2-13 | 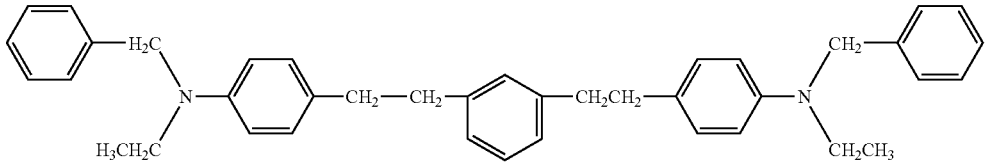 |
| 2-14 | 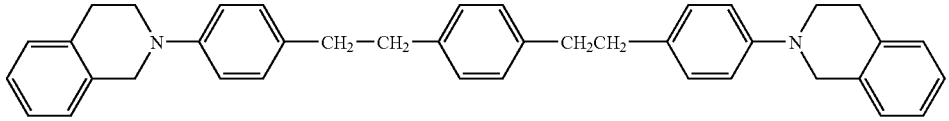 |
| 2-15 | 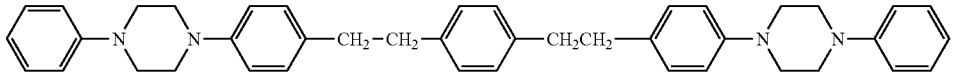 |

A content of the compounds having the formulae (1) and/or (2) is preferably from 0.01 to 150% by weight per 100% by weight of the binder resin.

When less than 0.01% by weight, the resistance against the oxidized gas deteriorates. When greater than 150% by weight, the filming strength decreases and the abrasion resistance deteriorates.

When a coating liquid including the compounds having the formulae (1) and/or (2) and the organic compound having an acid value of from 10 to 700 (mg KOH/g) has to be stored, a specific antioxidant has to be included in the coating liquid to prevent a salt production due to the interaction. The salt production causes not only a discoloration of the coating liquid but also an increase of residual potential of the resultant electrophotographic photoreceptor. The temporal storage instability of the coating liquid due to the salt production is caused by constitutions of the compounds having the formulae (1) and/or (2), and the present inventors discovered that the temporal storage instability can be solved by including an antioxidant in the coating liquid.

Typical antioxidants mentioned later can be used as the antioxidant for use in the present invention. Among the antioxidants, (c) a hydroquinone compound and (f) a hindered amine compound are effectively used. However, these antioxidants are used to protect the compound having the formulae (1) and/or (2) in the coating liquid, which is a different purpose from a purpose mentioned later. Therefore, these antioxidants are preferably included in the coating liquid before the compound having the formulae (1) and/or (2) is included therein. A content of the antioxidants is preferably from 0.1 to 200% by weight per 100% by weight of the organic compound having an acid value of from 10 to 700 (mg KOH/g) to exert temporal storage stability of the coating liquid.

A charge transport polymer material having a capability of a charge transport material and a capability of a binder resin is preferably used in the charge transport layer 37. A charge transport layer including the charge transport polymer material has a good abrasion resistance. Known charge transport polymer materials can be used, and in particular, a polycarbonate including a triarylamine structure in its main chain and/or a side chain is preferably used. Among the charge transport polymer materials, the charge transport polymer material shaving the following formulae (I) to (X) are preferably used. Specific examples of the charge transport polymer materials are shown as follows:

(I)

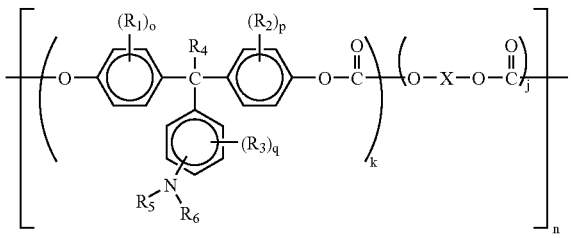

wherein, $R_1$, $R_2$ and $R_3$ independently represent a substituted or unsubstituted alkyl group, or a halogen atom; $R_4$ represents a hydrogen atom, or a substituted or unsubstituted alkyl group; $R_5$, and R6 independently represent a substituted or unsubstituted aryl group; o, p and q independently represent 0 or an integer of from 1 to 4; k is a number of from 0.1 to 1.0 and j is a number of from 0 to 0.9; n represents a repeating number and is an integer of from 5 to 5000; and X represents a divalent aliphatic group, a divalent alicyclic group or a divalent group having the following formula:

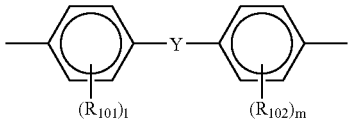

wherein, $R_{101}$ and $R_{102}$ independently represent a substituted or unsubstituted alkyl group, an aromatic ring group or a halogen atom; 1 and m represent 0 or an integer of from 1 to 4; and Y represents a direct bonding, a linear alkylene group, a branched alkylene group, a cyclic alkylene group, —O—, —S—, —SO—, —SO2—, —CO—, —CO—O—Z—O—CO— (Z represents a divalent aliphatic group), or a group having the following formula:

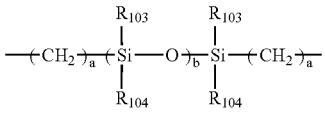

wherein, a is an integer of from 1 to 20; b is an integer of from 1 to 2000; and $R_{103}$ and $R_{104}$ independently represent a substituted or unsubstituted alkyl group, or a substituted or unsubstituted aryl group;

(II)

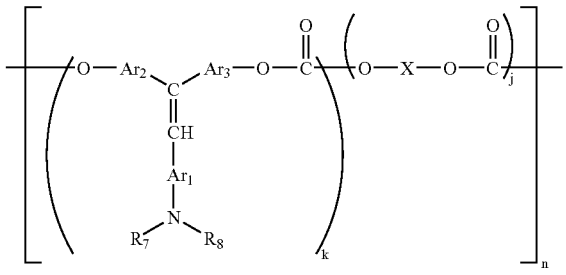

wherein, $R_7$ and $R_8$ represent a substituted or unsubstituted aryl group; $Ar_1$, $Ar_2$ and $Ar_3$ independently represent an arylene group; and X, k, j and n are the same in formula (I);

(III)

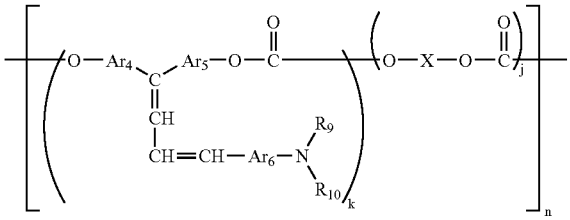

wherein, $R_9$ and $R_{10}$ represent a substituted or unsubstituted aryl group; $Ar_4$, $Ar_5$ and $Ar_6$ independently represent an arylene group; and X, k, j and n are the same in formula (I);

(IV)

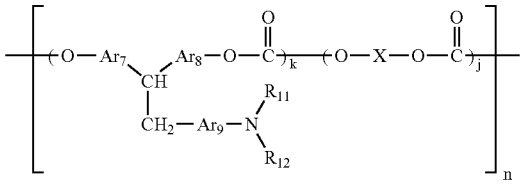

wherein, $R_{11}$ and $R_{12}$ represent a substituted or unsubstituted aryl group; $Ar_7$, $Ar_8$ and $Ar_9$ independently represent an arylene group; p is an integer of from 1 to 5; and X, k, j and n are the same in formula (I);

(V)

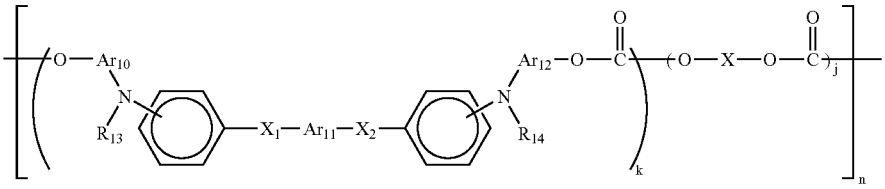

wherein, $R_{13}$ and $R_{14}$ represent a substituted or unsubstituted aryl group; $Ar_{10}$, $Ar_{11}$ and $Ar_{12}$ independently represent an arylene group; $X_1$ and $X_2$ represent a substituted or unsubstituted ethylene group, or a substituted or unsubstituted vinylene group; and X, k, j and n are the same in formula (I);

(VI)

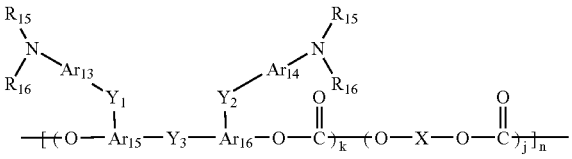

wherein, $R_{15}$, $R_{16}$, $R_{17}$ and $R_{18}$ represent a substituted or unsubstituted aryl group; $Ar_{13}$, $Ar_{14}$, $Ar_{15}$ and $Ar_{16}$ independently represent an arylene group; $Y_1$, $Y_2$ and $Y_3$ independently represent a direct bonding, a substituted or unsubstituted alkylene group, a substituted or unsubstituted cycloalkylene group, a substituted or unsubstituted alkyleneether group, an oxygen atom, a sulfur atom, or a vinylene group; and X, k, j and n are the same in formula (I);

(VII)

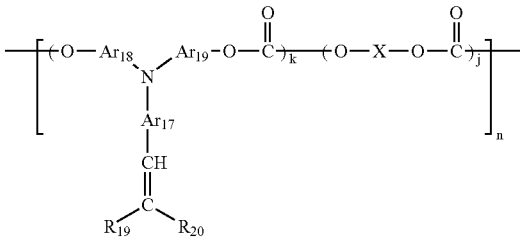

wherein, $R_{19}$ and $R_{20}$ represent a hydrogen atom, or substituted or unsubstituted aryl group, and $R_{19}$ and $R_{20}$ may form a ring; $Ar_{17}$, $Ar_{18}$ and $Ar_{19}$ independently represent an arylene group; and X, k, j and n are the same in formula (I);

(VIII)

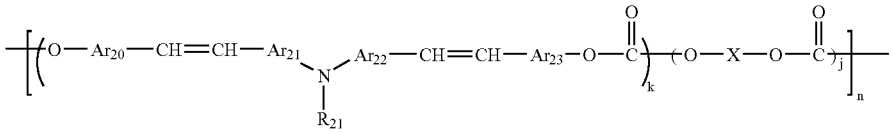

wherein, $R_{21}$ represents a substituted or unsubstituted aryl group; $Ar_{20}$, $Ar_{21}$, $Ar_{22}$ and $Ar_{23}$ independently represent an arylene group; and X, k, j and n are the same in formula (I);

(IX)

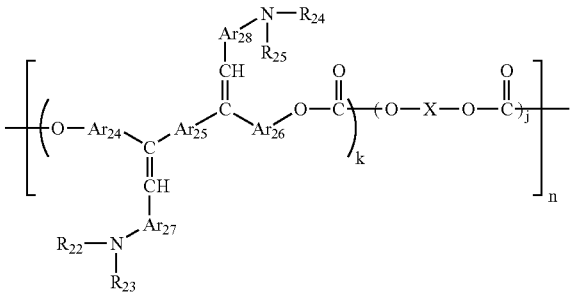

wherein, $R_{22}$, $R_{23}$, $R_{24}$ and $R_{25}$ represent a substituted or unsubstituted aryl group; $Ar_{24}$, $Ar_{25}$, $Ar_{26}$, $Ar_{27}$ and $Ar_{28}$ independently represent an arylene group; and X, k, j and n are the same in formula (I);

(X)

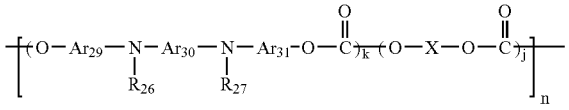

wherein, $R_{26}$ and $R_{27}$ independently represent a substituted or unsubstituted aryl group; $Ar_{29}$, $Ar_{30}$ and $Ar_{31}$ independently represent an arylene group; and X, k, j and n are the same in formula (I).

Conventional coating methods such as dip coating methods, spray coating methods, bead coating methods, nozzle coating methods, spinner coating methods and ring coating methods can be used as a coating method of coating the coating liquid for forming the charge transport layer 37 in FIG. 2. When a filler is included in a surface of the photosensitive layer, the filler can be included in the whole photosensitive layer. However, it is preferable to form a filler concentration gradient such that an outermost surface of the charge transport layer has the highest filler concentration and an interface with the substrate has the lowest filler concentration, or form a charge transport layer having plural layers, in which a filler concentration sequentially becomes higher from the substrate side toward the surface side.

Next, a single-layered photosensitive layer (FIGS. 1 and 3) will be explained. A photoreceptor in which the above-mentioned charge generation material is dispersed in the binder resin can be used. The photosensitive layer 33 can be formed by coating a coating liquid in which a charge generation material, a charge transport material and a binder resin are dissolved or dispersed in a proper solvent, and then drying the coated liquid. In addition, the photosensitive layer 33 can optionally include additives such as plasticizers, leveling agents and antioxidants. The above-mentioned charge generation materials for use in the charge generation layer 35 can be used.

Suitable binder resins include the resins mentioned above for use in the charge transport layer 37. The resins mentioned above for use in the charge generation layer 35 can be added as a binder resin. In addition, the charge transport polymer materials mentioned above can also be used as a binder resin. A content of the charge generation material is preferably from 5 to 40 parts by weight per 100 parts by weight of the binder resin. A content of the charge transport material is preferably from 0 to 190 parts by weight, and more preferably from 50 to 150 parts by weight, per 100 parts by weight of the binder resin. The single-layered photosensitive layer can be formed by coating a coating liquid in which a charge generation material and a binder and optionally a charge transport material are dissolved or dispersed in a solvent such as tetrahydrofuran, dioxane, dichloroethane, cyclohexane, etc. by a coating method such as dip coating, spray coating, bead coating and ring coating. The thickness of the photosensitive layer is preferably from 5 to 25 μm.

When the photosensitive layer is an outermost surface, at least a filler is effectively included in a surface of the photosensitive layer. In this case, any fillers for use in the charge transport layer 37 can be used. The filler can be included in the whole photosensitive layer as it can in the charge transport layer. However, it is preferable to form a filler concentration gradient or form a charge transport layer having plural layers, in which a filler concentration sequentially becomes higher from the substrate side toward the surface side.

The single-layered and multi-layered photoreceptors of the present invention preferably has the protective layer 39 to protect the photosensitive layers as the second embodiment (specifically shown in FIGS. 3, 4 and 5). In this case, the protective layer 39 is an outermost layer. Suitable materials for use in the protective layer (9) include ABS resins, ACS resins, olefin-vinyl monomer copolymers, chlorinated polyethers, aryl resins, phenolic resins, polyacetal, polyamides, polyamideimide, polyacrylates, polyarylsulfone, polybutylene, polybutylene terephthalate, polycarbonate, polyethersulfone, polyethylene, polyethylene terephthalate, polyimides, acrylic resins, polymethylpentene, polypropylene, polyphenyleneoxide, polysulfone, polystyrene, AS resins, butadiene-styrene copolymers, polyurethane, polyvinyl chloride, polyvinylidene chloride, epoxy resins and the like. Particularly, a polycarbonate or a polyarylate is preferably and effectively used in term of dispersibility of the filler, the residual potential and the coating defect.

As shown in FIGS. 4 and 5, when the photosensitive layer includes the charge generation layer 35 and charge transport layer 37, the charge generation layer 35 and charge transport layer 37 can be formed similarly to those in FIG. 2. Further, as shown in FIG. 3, when the photosensitive layer is a single layer, the photosensitive layer 33 can be formed similarly to that in FIG. 1.

Further, the protective layer 39 includes a filler to increase an abrasion resistance thereof, at least an organic compound having an acid value of from 1 to 700 (mg KOH/g) and at least a compound having the formula (1) or (2). Any filler materials included in the charge transport layer 37 can be used. Among the materials, an inorganic pigment is preferably used in terms of the abrasion resistance, in particular, a metal oxide having a pH not less than 5 or a dielectric constant not less than 5 is more preferably used because of preventing blurred images. Such an insulative filler includes titanium oxide, alumina, zinc oxide, zirconium oxide, etc. Such a filler as has a pH not less than 5 or a dielectric constant not less than 5 can be used alone, and a mixture of a filler having a pH not greater than 5 and a filler having a pH not less than 5 or of a filler having a dielectric constant not greater than 5 and a filler having a dielectric constant not less than 5 can be used. Among these filler materials, α-type alumina is preferably used because this has a good abrasion resistance due to its high insulation, heat resistance and hardness, and is difficult to agglutinate.

These fillers are preferably treated with at least one surface treating agent to improve the dispersibility thereof. Any surface treating agent for use in the charge transport layer 37 can be used. The surface treating agent can be used alone or in combination. A content of the surface treating agent is the same as that of the charge transport layer 37.

In addition, the filler preferably has an average primary particle diameter of from 0.01 to 0.5 μm in terms of light transmittance and abrasion resistance of the protective layer. When less than 0.01 μm, the abrasion resistance and the dispersibility deteriorates. When greater than 0.5 μm, it is probable that the sedimentation of the filler is accelerated and the toner filming occurs.

The protective layer 39 preferably includes a filler in an amount of from 0.1 to 50% by weight, more preferably from 5 to 50% by weight and most preferably from 10 to 40% by weight. When less than 0.1% by weight, the protective layer 39 does not have sufficient abrasion resistance. When greater than 50% by weight, a transparency of the protective layer 39 is impaired.

As the organic compound having an acid value of from 10 to 700 (mg KOH/g) included in the protective layer 39, any compounds used in the charge transport layer 37 in FIG. 2 can be used. A polycarboxylic acid is preferably used as is preferably used in the charge transport layer 37. As the polycarboxylic acid, any organic compounds including at least two or more carboxyl groups or their derivatives can be used. An organic acid such as a maleic acid, a citric acid, a tartaric acid and a succinic acid, and a polyester resin, an acrylic resin, a copolymer using an acrylic resin and a methacrylic resin, a styrene acrylic copolymers, etc. are preferably used. These can be used in combination, and straight chain organic fatty acids can be used alone or mixed with the polycarboxylic acid, which occasionally increase dispersibility of the filler.

The protective layer 39 includes an organic compound having an acid value of from 10 to 700 (mgKOH/g), and an organic compound having an acid value of from 10 to 400 (mg KOH/g) is preferably used, an organic compound having an acid value of from 30 to 400 (mg KOH/g) is more preferably used, and an organic compound having an acid value of from 30 to 200 (mg KOH/g) is most preferably used. When the acid value is higher than necessary, the resistance is decreased too much and blurred images are produced. When the acid value is too low, the content has to be increased and the residual potential is nor sufficiently decreased. In addition, the acid value of the material has to be determined based on a balance with the above-mentioned content. A higher acid value does not always reduce the residual potential effectively, and the reduction of residual potential largely depends upon a sorbability of the organic compound having an acid value of from 10 to 700 (mg KOH/g) to a filler. However, the acid value of the material does not have a direct influence on the reduction of residual potential, but the structure or molecular weight of the organic compound and dispersibility of the filler largely affects the reduction of residual potential.

A content of the organic compound having an acid value of from 10 to 700 (mg KOH/g) is determined by the acid value and a content of the filler. When two or more of the organic compound having an acid value of from 10 to 700 (mg KOH/g) are used, the following formula (a) is preferably satisfied:

$$0.1 \leqq \text{acid value equivalent } (A \times B/C) \leqq 20 \quad \text{(a)}$$

wherein A is a content of an organic compound having an acid value of from 10 to 700 (mg KOH/g); B is a content of another organic compound having an acid value of from 10 to 700 (mg KOH/g); and C is a content of the filler, and wherein A, B and C are preferably minimum quantities in a range satisfying the formula (a).

When the content of the organic compound having an acid value of from 10 to 700 (mg KOH/g) is more than necessary, the filler is not sufficiently dispersed adversely and blurred images are occasionally produced. When the content is too small, the filler is not sufficiently dispersed and the residual potential is not sufficiently reduced.

The content of the organic compound having an acid value of from 10 to 700 (mg KOH/g) is preferably from 0.01 to 50% by weight, and more preferably from 0.1 to 20% by weight per 100% by weight of the filler.

As the compounds having the formulae (1) and (2) included in the protective layer 39 to improve resistance against an oxidized gas, the compounds for use in the charge transport layer 37 can be used.

Any solvents for use in the charge transport layer 37 such as tetrahydrofuran, dioxane, toluene, dichloromethane, monochlorobenzene, dichloroethane, cyclohexanone, methyl ethyl ketone and acetone can be used for forming the protective layer 39. However, a high-viscosity solvent is preferably used in dispersion, and a high-volatile solvent is preferably used in coating. When such a solvent as satisfies these conditions is not available, two or more solvents having respective properties can be used in combination, which improves dispersibility of the filler and decreases the residual potential.

In addition, the low-molecular-weight charge transport material or the high-molecular-weight charge transport material used in the charge transport layer 37 is preferably and effectively included in the protective layer 39.

The filler included in the protective layer 39 can be dispersed with at least an organic solvent and the organic compound having an acid value of from 10 to 400 (mg KOH/g) using a conventional method such as a ball mill, an attritor, a sand mill and a supersonic. Among these methods, the ball mill with little interfusion of impurities from outside, which can increase a contact efficiency of the filler and the organic compound having an acid value of from 10 to 400 (mg KOH/g) is preferably used in terms of dispersibility. Any conventional media such as a zirconia, an alumina and an agate can be used, however, in particular, the alumina is preferably used in terms of dispersibility of the filler and reduction of the residual potential. The zirconia is largely abraded when dispersed and remarkably increases the residual potential. Further, the abraded powder is mixed, and the dispersibility largely deteriorates and sedimentaion of the filler is accelerated. To the contrary, when the alumina is used as the media, the alumina is abraded when dispersed, but the abraded amount is low and the abraded powder scarcely affect the residual potential. In addition, the abraded powder scarcely affect the dispersibility. Therefore, the alumina is preferably used as a media for use in the dispersion.

The organic compound having an acid value of from 10 to 700 (mg KOH/g) is preferably included in the protective layer 39 before dispersion because of preventing agglomeration and sedimentation of the filler and remarkably improving dispersibility of the filler. To the contrary, the binder resin and the charge transport material can be included before dispersion. However, in this case, dispersibility slightly deteriorates, and therefore the binder resin and the charge transport material is preferably included after dispersion in a state of being dissolved in an organic solvent.

As a method of forming the protective layer, conventional methods such as dip coating methods, spray coating methods, bead coating methods nozzle coating methods, spinner coating methods and ring coating methods. Particularly, the spray coating methods are preferably used in terms of coating uniformity. Further, the protective layer can be formed by a one-time coating, however, the protective layer preferably has multiple layers by coating twice or more times in terms of uniformity of the filler in the layer. This decreases the residual potential, and improves the image resolution and the abrasion resistance. The protective layer preferably has a thickness of from about 0.1 to 10 μm.

In the present invention, the residual potential can be largely decreased and the thickness of the- protective layer can freely be adjusted by including the organic compound having an acid value of from 10 to 700 (mg KOH/g). However, since produced images tend to slightly deteriorate when the thickness is too large, the protective layer preferably has the minimum thickness required.

In the photoreceptor of the present invention, an undercoat layer may be formed between the substrate 31 and the photosensitive layer. The undercoat layer includes a resin as a main component. Since a photosensitive layer is typically formed on the undercoat layer by coating a liquid including an organic solvent, the resin in the undercoat layer preferably has good resistance to general organic solvents. Specific examples of such resins include water-soluble resins such as polyvinyl alcohol resins, casein and polyacrylic acid sodium salts; alcohol soluble resins such as nylon copolymers and methoxymethylated nylon resins; and thermosetting resins capable of forming a three-dimensional network such as polyurethane resins, melamine resins, alkyd-melamine resins, epoxy resins and the like. The undercoat layer may include a fine powder of metal oxides such as titanium oxide, silica, alumina, zirconium oxide, tin oxide and indium oxide to prevent occurrence of moiré in the recorded images and to decrease residual potential of the photoreceptor.

The undercoat layer can also be formed by coating a coating liquid using a proper solvent and a proper coating method similarly to those for use in formation of the photosensitive layer mentioned above. The undercoat layer may be formed using a silane coupling agent, titanium coupling agent or a chromium coupling agent. In addition, a layer of aluminum oxide which is formed by an anodic oxidation method and a layer of an organic compound such as polyparaxylylene (parylene) or an inorganic compound such as SiO, $SnO_2$, $TiO_2$, ITO or $CeO_2$ which is formed by a vacuum evaporation method is also preferably used as the undercoat layer. Besides these materials, known materials can be used. The thickness of the undercoat layer is preferably from 0 to 5 μm.

In the photoreceptor of the present invention, an intermediate layer may be formed between the photosensitive layer and the protective layer. The intermediate layer includes a resin as a main component. Specific examples of the resin include polyamides, alcohol soluble nylons, water-soluble polyvinyl butyral, polyvinyl butyral, polyvinyl alcohol, and the like. The intermediate layer can be formed by one of the above-mentioned known coating methods. The thickness of the intermediate layer is preferably from 0.05 to 2 μm.

In the present invention, one or more additives such as antioxidants, plasticizers, lubricants, ultraviolet absorbents, low molecular weight charge transport materials and leveling agents can be included in each of the layers, i.e., the charge generation layer, charge transport layer, undercoat layer, protective layer and intermediate layer to improve the stability to withstand environmental conditions, namely to avoid decrease of photosensitivity and increase of residual potential. Such compounds will be shown as follows.

Suitable antioxidants for use in each of the layers include the following compounds, but are not limited thereto.

(a) Phenolic Compounds 2,6-di-t-butyl-p-cresol, butylated hydroxyanisole, 2,6-di-t-butyl-4-ethylphenol, n-octadecyl-3-(4'-hydroxy-3', 5'-di-t-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)b enzene, tetrakis-[methylene-3-(3', 5'-di-t-butyl-4'-hydroxyphenyl)pr opionate]methane, bis[3, 3'-bis(4'-hydroxy-3'-t-butylphenyl)butyric acid]glycol ester, tocophenol compounds, and the like.

(b) Paraphenylenediamine Compounds

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, and the like.

(c) Hydroquinone Compounds 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone and the like.

(d) Organic Sulfur-containing Compounds

Dilauryl-3,3'-thiodipropionate, distearyl-3,3'-thiodipropionate, ditetradecyl-3,3'-thiodipropionate, and the like.

(e) Organic Phosphorus-containing Compounds

Triphenylphosphine, tri(nonylphenyl)phosphine, tri(dinonylphenyl)phosphine, tricresylphosphine, tri(2,4-dibutylphenoxy)phosphine and the like.

Suitable plasticizers for use in the layers of the photoreceptor include the following compounds but are not limited thereto:

(a) Phosphoric Acid Esters Plasticizers

Triphenyl phosphate, tricresyl phosphate, trioctyl phosphate, octyldiphenyl phosphate, trichloroethyl phosphate, cresyldiphenyl phosphate, tributyl phosphate, tri-2-ethylhexyl phosphate, triphenyl phosphate, and the like.

(b) Phthalic Acid Esters Plasticizers

Dimethyl phthalate, diethyl phthalate, diisobutyl phthalate, dibutyl phthalate, diheptyl phthalate, di-2-ethylhexyl phthalate, diisooctyl phthalate, di-n-octyl phthalate, dinonyl phthalate, diisononyl phthalate, diisodecyl phthalate, diundecyl phthalate, ditridecyl phthalate, dicyclohexyl phthalate, butylbenzyl phthalate, butyllauryl phthalate, methyloleyl phthalate, octyldecyl phthalate, dibutyl fumarate, dioctyl fumarate, and the like.

(c) Aromatic Carboxylic Acid Esters Plasticizers

Trioctyl trimellitate, tri-n-octyl trimellitate, octyl oxybenzoate, and the like.

(d) Dibasic Fatty Acid Esters Plasticizers

Dibutyl adipate, di-n-hexyl adipate, di-2-ethylhexyl adipate, di-n-octyl adipate, n-octyl-n-decyl adipate, diisodecyl adipate, dialkyl adipate, dicapryl adipate, di-2-etylhexyl azelate, dimethyl sebacate, diethyl sebacate, dibutyl sebacate, di-n-octyl sebacate, di-2-ethylhexyl sebacate, di-2-ethoxyethyl sebacate, dioctyl succinate, diisodecyl succinate, dioctyl tetrahydrophthalate, di-n-octyl tetrahydrophthalate, and the like.

(e) Fatty Acid Ester Derivatives

Butyl oleate, glycerin monooleate, methyl acetylricinolate, pentaerythritol esters, dipentaerythritol hexaesters, triacetin, tributyrin, and the like.

(f) Oxyacid Esters Plasticizers

Methyl acetylricinolate, butyl acetylricinolate, butylphthalylbutyl glycolate, tributyl acetylcitrate, and the like.

(g) Epoxy Plasticizers

Epoxydized soybean oil, epoxydized linseed oil, butyl epoxystearate, decyl epoxystearate, octyl epoxystearate, benzyl epoxystearate, dioctyl epoxyhexahydrophthalate, didecyl epoxyhexahydrophthalate, and the like.

(h) Dihydric Alcohol Esters Plasticizers

Diethylene glycol dibenzoate, triethylene glycol di-2-ethylbutylate, and the like.

(i) Chlorine-containing Plasticizers

Chlorinated paraffin, chlorinated diphenyl, methyl esters of chlorinated fatty acids, methyl esters of methoxychlorinated fatty acids, and the like.

(j) Polyester Plasticizers

Polypropylene adipate, polypropylene sebacate, acetylated polyesters, and the like.

(k) Sulfonic Acid Derivatives

P-toluene sulfonamide, o-toluene sulfonamide, p-toluene sulfoneethylamide, o-toluene sulfoneethylamide, toluene sulfone-N-ethylamide, p-toluene sulfone-N-cyclohexylamide, and the like.

(1) Citric Acid Derivatives

Triethyl citrate, triethyl acetylcitrate, tributyl citrate, tributyl acetylcitrate, tri-2-ethylhexyl acetylcitrate, n-octyldecyl acetylcitrate, and the like.

(m) Other Compounds

Terphenyl, partially hydrated terphenyl, camphor, 2-nitro diphenyl, dinonyl naphthalene, methyl abietate, and the like.

Suitable lubricants for use in the layers of the photoreceptor include the following compounds, but are not limited thereto.

(a) Hydrocarbon Compounds

Liquid paraffins, paraffin waxes, micro waxes, low molecular weight polyethylenes, and the like.

(b) Fatty Acid Compounds

Lauric acid, myristic acid, palmitic acid, stearic acid, arachidic acid, behenic acid, and the like.

(c) Fatty Acid Amide Compounds

Stearic acid amide, palmitic acid amide, oleic acid amide, methylenebisstearamide, ethylenebisstearamide, and the like.

(d) Ester Compounds

Lower alcohol esters of fatty acids, polyhydric alcohol esters of fatty acids, polyglycol esters of fatty acids, and the like.

(e) Alcohol Compounds

Cetyl alcohol, stearyl alcohol, ethylene glycol, polyethylene glycol, polyglycerol, and the like.

(f) Metallic Soaps

Lead stearate, cadmium stearate, barium stearate, calcium stearate, zinc stearate, magnesium stearate, and the like.

(g) Natural Waxes

Carnauba wax, candelilla wax, beeswax, spermaceti, insect wax, montan wax, and the like.

(h) Other Compounds

Silicone compounds, fluorine compounds, and the like.

Suitable ultraviolet absorbing agents for use in the layers of the photoreceptor include the following compounds, but are not limited thereto.

(a) Benzophenone Compounds 2-hydroxybenzophenone, 2,4-dihydroxybenzophenone, 2,2', 4-trihydroxybenzophenone, 2,2', 4,4'-tetrahydroxybenzophenone, 2,2'-dihydroxy-4-methoxybenzophenone, and the like (b) Salicylate Compounds Phenyl salicylate, 2,4-di-t-butylphenyl-3,5-di-t-butyl-4-hydroxybenzoate, and the like.

(c) Benzotriazole Compounds (2'-hydroxyphenyl)benzotriazole, (2'-hydroxy-5'-methylphenyl)benzotriazole and (2'-hydroxy-3'-t-butyl-5'-methylphenyl)-5-chlorobenzotriazo le.

(d) Cyano Acrylate Compounds

Ethyl-2-cyano-3,3-diphenyl acrylate, methyl-2-carbomethoxy-3-(paramethoxy) acrylate, and the like.

(e) Quenchers (Metal Complexes)

Nickel(2,2'-thiobis(4-t-octyl)phenolate)-n-butylamine, nickeldibutyldithiocarbamate, cobaltdicyclohexyldithiophosphate, and the like.

(f) HALS (Hindered Amines)

Bis(2,2,6,6-tetramethyl-4-piperidyl)sebacate, bis(1,2,2,6,6-pentamethyl-4-piperidyl)sebacate, 1-[2-{3-(3,5-di-t-butyl-4-hydroxyphenyl)propionyloxy}ethyl]-4-{3-(3,5-di-t-butyl-4-hydroxyphenyl)propionyloxy}-2,2,6,6-tetrametylpyridine, 8-benzyl-7,7,9,9-tetramethyl-3-octyl-1,3,8-triazaspiro[4,5] undecane-2,4-dione, 4-benzoyloxy-2,2,6,6-tetramethylpiperidine, and the like.

Next, the image forming method and apparatus of the present invention will be explained, referring to drawings. Specifically, the image forming method typified by an electrophotographic image forming method and the image forming apparatus typified by an electrophotographic image forming apparatus will be explained.

Figure 6:
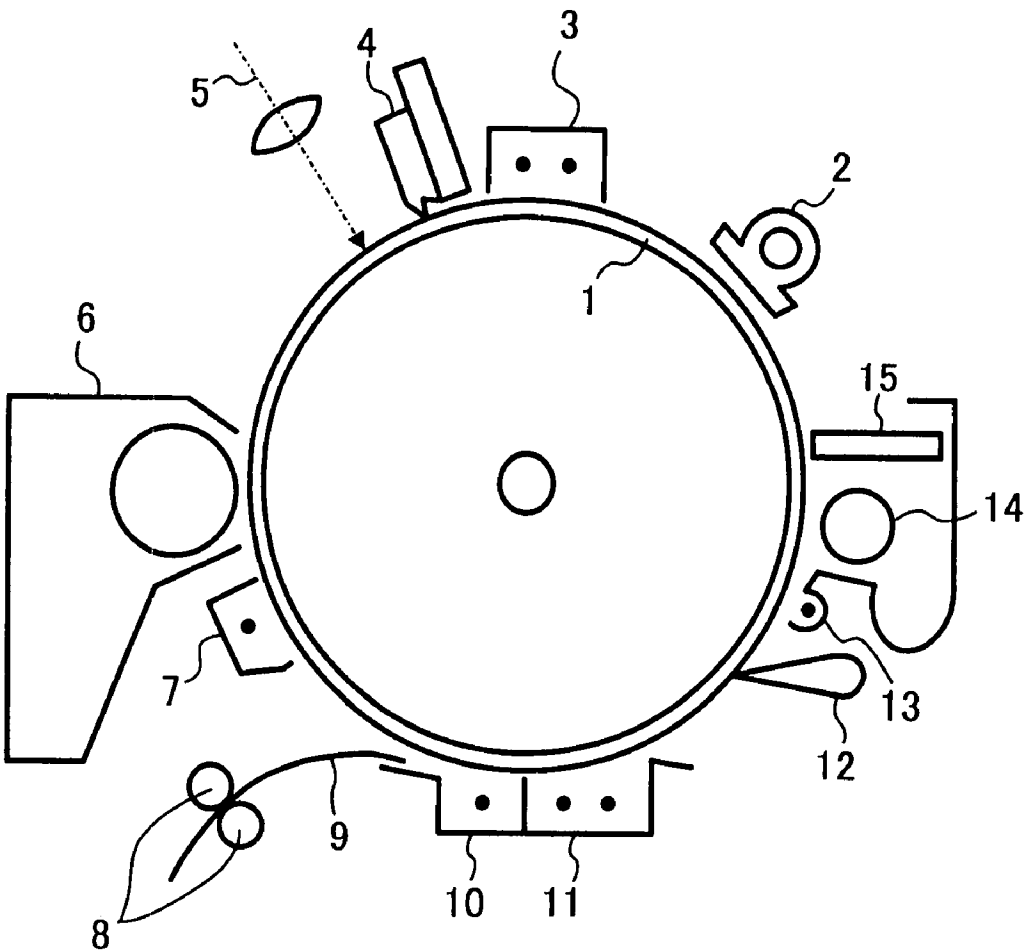
FIG. 6 is a schematic view illustrating a partial cross-section for explaining an embodiment of the electrophotographic image forming method and apparatus of the present invention.

FIG. 6 is a schematic view for explaining the electrophotographic method and apparatus of the present invention, and a modified embodiment as mentioned below belongs to the present invention.

In FIG. 6, a photoreceptor 1 includes at least a photosensitive layer and an outermost layer thereof includes a filler. The photoreceptor 1 is drum-shaped, and may be sheet-shaped or endless-belt shaped. Any known chargers such as a corotron, a scorotron, a solid state charger and a charging roller can be used for a charger 3, a pre-transfer charger 7, a transfer charge 10, a separation charger 11 and a pre-cleaning charger 13.

The above-mentioned chargers can be used as transferers, and typically a combination of the transfer charger 10 and the separation charger 11 is effectively used.

Suitable light sources for use in an imagewise light irradiator 5 and a discharging lamp 2 include fluorescent lamps, tungsten lamps, halogen lamps, mercury lamps, sodium lamps, light emitting diodes (LEDs), laser diodes (LDs), light sources using electroluminescence (EL) and the like. In addition, in order to obtain light having a desired wave length range, filters such as sharp-cut filters, band pass filters, near-infrared cutting filters, dichroic filters, interference filters, color temperature converting filters and the like can be used.

The above-mentioned light sources can be used for not only the processes mentioned above and illustrated in FIG. 6, but also other processes, such as a transfer process, a discharging process, a cleaning process, a pre-exposure process, which include light irradiation to the photoreceptor.

When a toner image formed on the photoreceptor 1 by a developing unit 6 is transferred onto a transfer sheet 9, the toner image is not all transferred thereon, and residual toner particles remain on the surface of the photoreceptor 1. The residual toner is removed from the photoreceptor by a fur brush 14 and a blade 15. The residual toner remaining on the photoreceptor 1 can be removed by only a cleaning brush. Suitable cleaning brushes include known cleaning brushes such as fur brushes and mag-fur brushes.

When the photoreceptor which is previously charged positively is exposed to imagewise light, an electrostatic latent image having a positive or negative charge is formed on the photoreceptor. When the latent image having a positive charge is developed with a toner having a negative charge, a positive image can be obtained. In contrast, when the latent image having a positive charge is developed with a toner having a positive charge, a negative image (i.e., a reversal image) can be obtained.

As the developing method, known developing methods can be used. In addition, as the discharging methods, known discharging methods can also be used.

Figure 7:
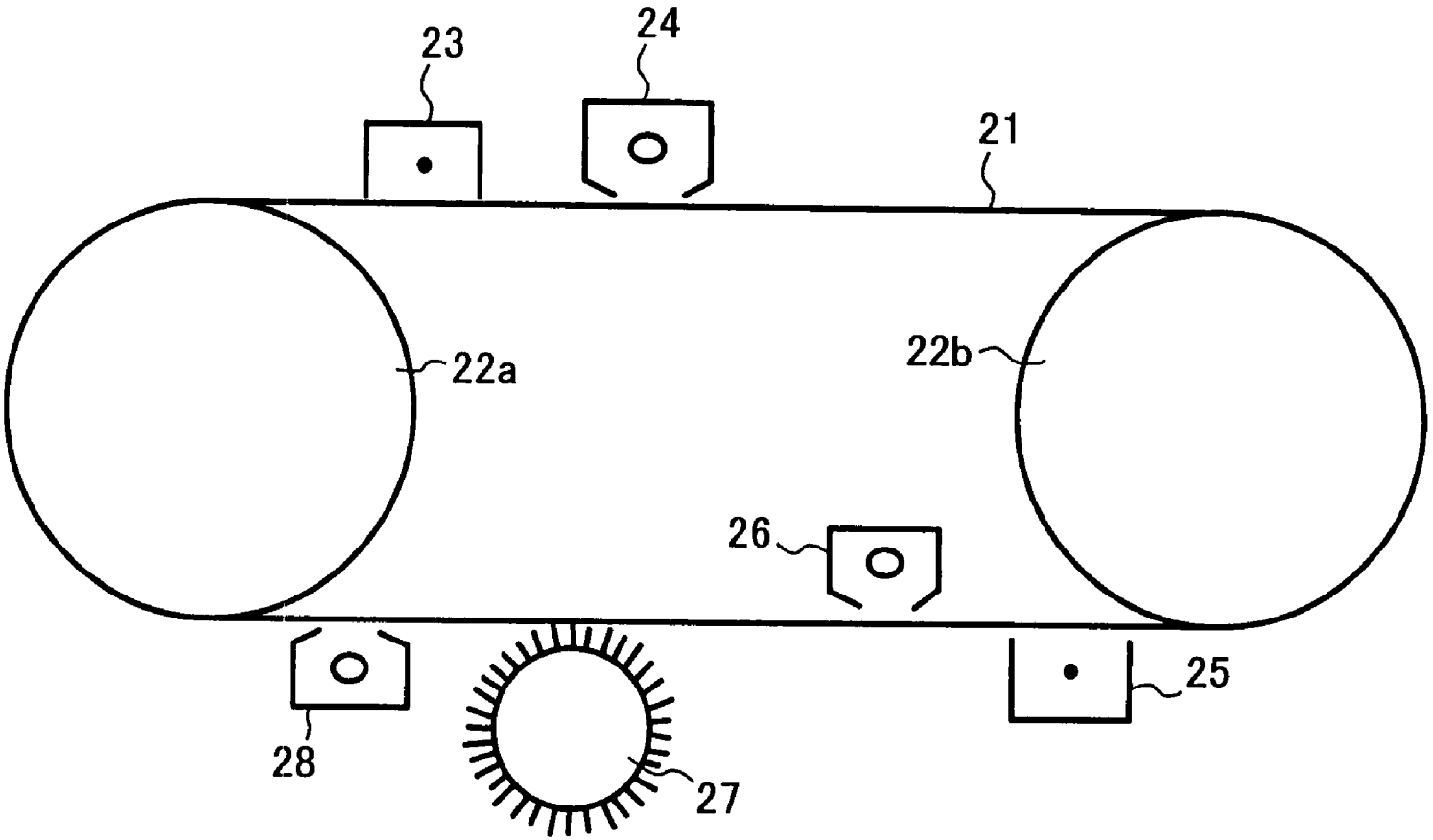
FIG. 7 is a schematic view for explaining another embodiment of the electrophotographic image forming method and apparatus of the present invention.

FIG. 7 is a schematic view for explaining another embodiment of the electrophotographic image forming method and apparatus of the present invention. A photoreceptor 21 includes at least a photosensitive layer and the most surface layer includes a filler. The photoreceptor is rotated by rollers 22*a* and 22*b*. Charging using a charger 23, imagewise exposure using an imagewise light irradiating device 24, developing using a developing unit (not shown), transferring using a transfer charger 25, pre-cleaning using a light source 26, cleaning using a cleaning brush 27 and discharging using a discharging light source 28 are repeatedly performed. In FIG. 7, the pre-cleaning light irradiating is performed from the side of the substrate of the photoreceptor 21. In this case, the substrate has to be light-transmissive.

The image forming apparatus of the present invention is not limited to the image forming units as shown in FIGS. 6 and 7. For example, although the pre-cleaning light irradiation is performed from the substrate side in FIG. 7, the pre-cleaning light irradiating operation can be performed from the photosensitive layer side of the photoreceptor. In addition, the light irradiation in the light image irradiating process and the discharging process may be performed from the substrate side of the photoreceptor.

Figure 8:
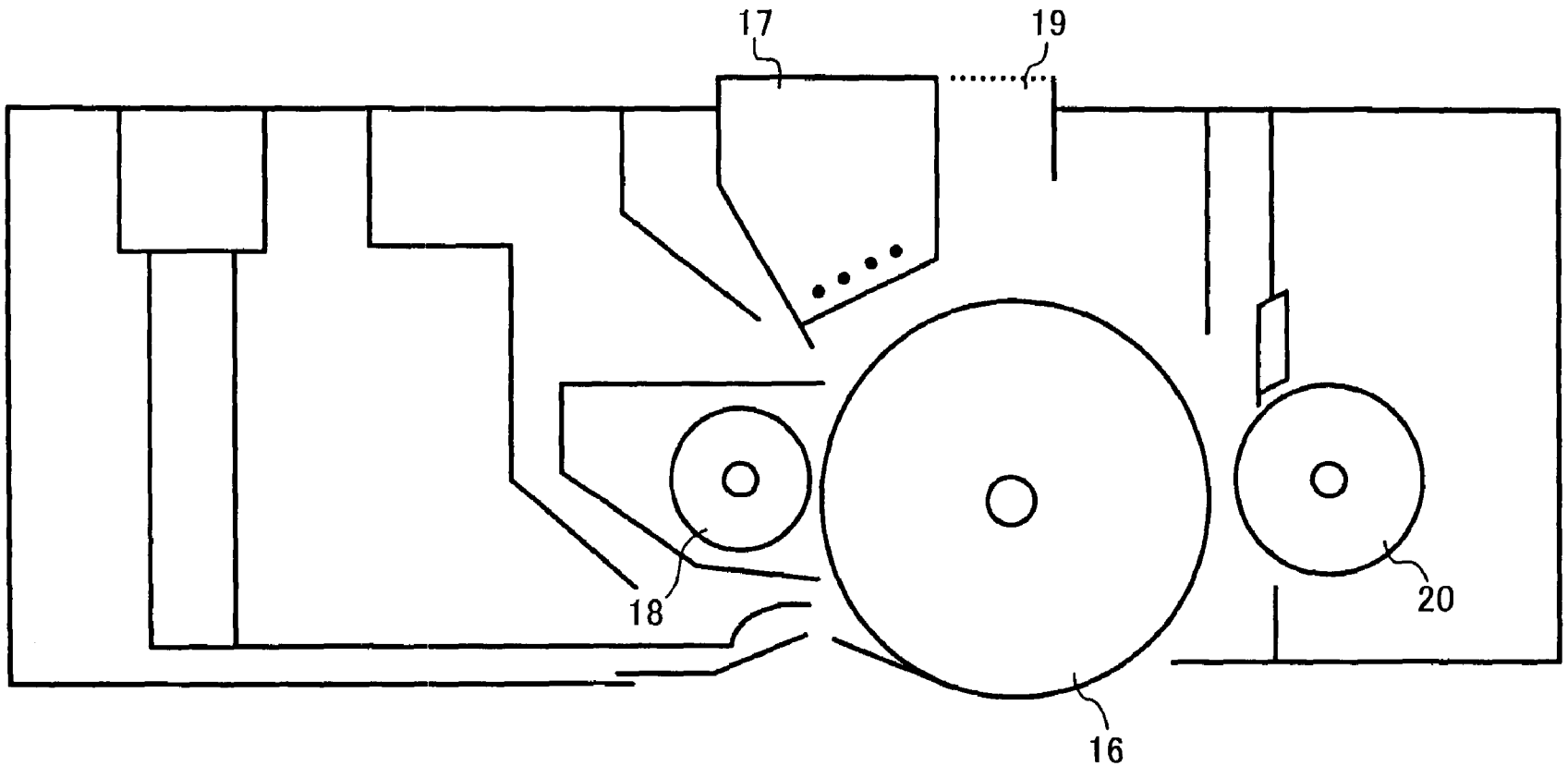
FIG. 8 is a schematic view illustrating a cross-section of an embodiment of the process cartridge for the electrophotographic image forming apparatus of the present invention.
Figure 9:
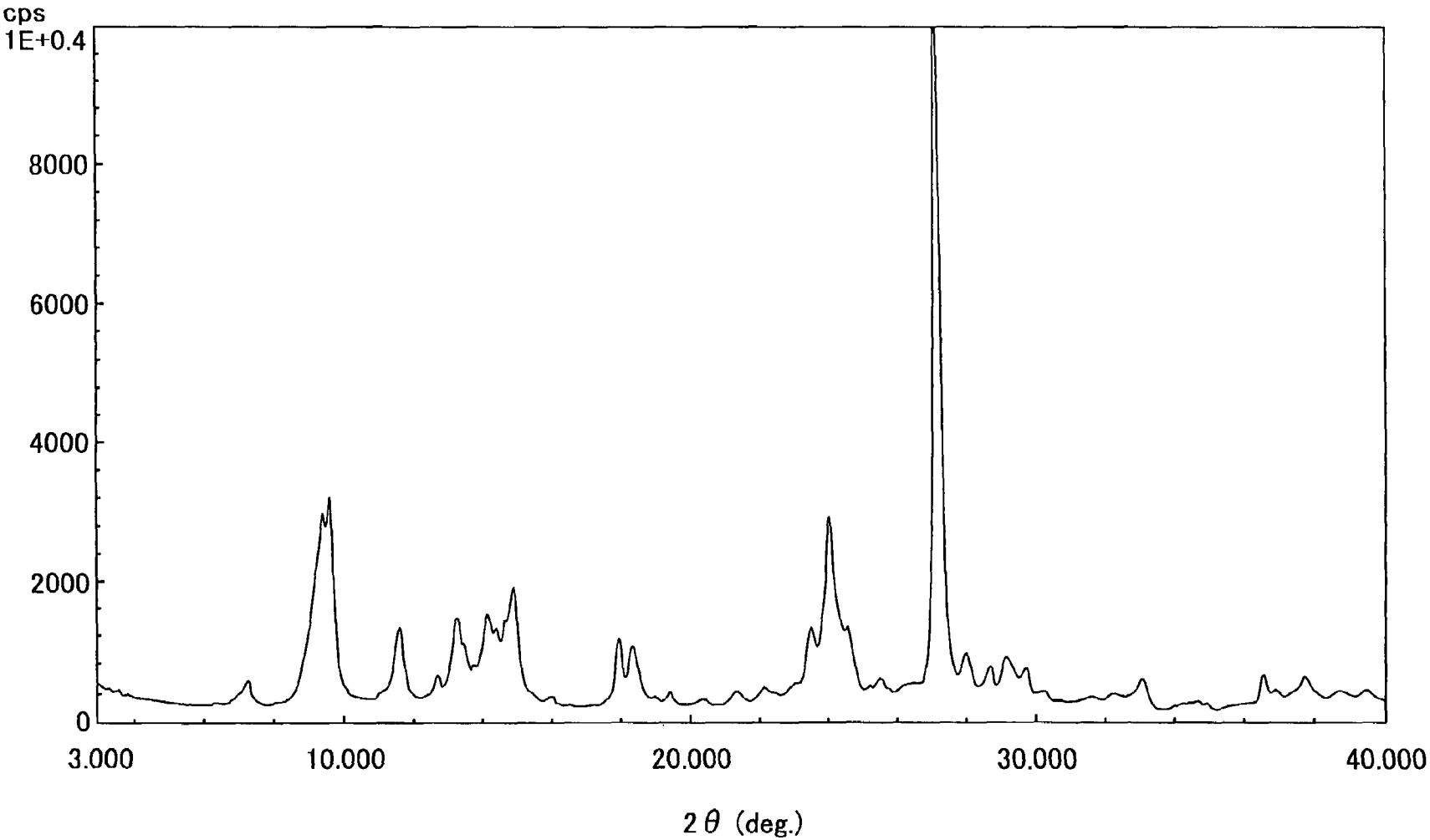
FIG. 9 is a chart showing a XD spectrum of the titanylphthalocyanine used in Example 18 of the present invention.

The above-mentioned image forming unit may be fixedly set in a copier, a facsimile or a printer. However, the image forming unit may be set therein as a process cartridge. The process cartridge means an image forming unit (or device) which includes a photoreceptor, a charger, an imagewise light irradiator, an image developer, an image transferer, a cleaner, and a discharger. Various process cartridges can be used in the present invention. FIG. 8 illustrates an embodiment of the process cartridge. A photoreceptor 16 includes at least a photosensitive layer on an electroconductive substrate, and an outermost layer thereof includes a filler.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

An undercoat coating liquid, a charge generation coating liquid and charge transport coating liquid, which have the following formulations, were coated in this order on an aluminium cylinder by a dip coating method and dried to prepare a photoreceptor 1 having an undercoat layer of 3.5 μm thick, a CGL of 0.2 μm thick, a CTL of 23 μm thick.

Undercoat Layer Coating Liquid

| | |
|---|---|
| Titanium dioxide powder | 400 |
| Melamine resin | 65 |
| Alkyd resin | 120 |
| 2-butanone | 400 |

CGL Coating Liquid

| | |
|---|---|
| Fluorenone bisazo pigment having the following formula: | 12 |

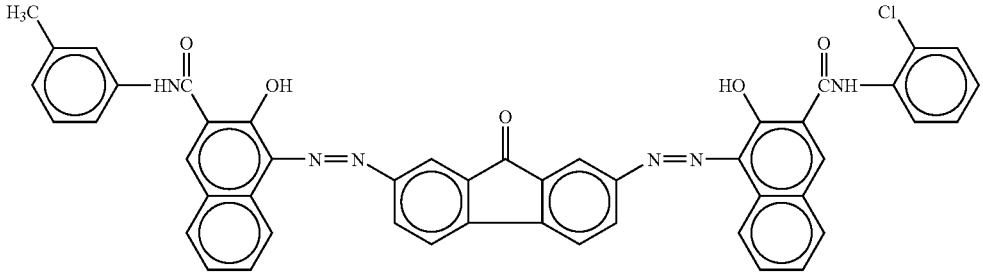

| | |
|---|---|
| Polyvinyl butyral | 5 |
| 2-butanone | 200 |
| Cyclohexanone | 400 |

CTL Coating Liquid

| | |
|---|---|
| Polycarbonate resin (Z polyca from Teijin Chemicals Ltd.) | 10 |
| CTM having the following formula: | 10 |

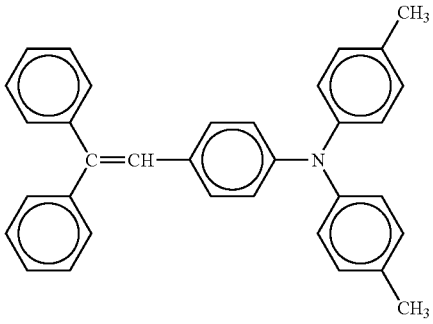

| | |
|---|---|
| Tetrahydrofuran | 100 |

A protective layer of 4 μm thick, having the following composition is further coated on the charge transport layer by a spray coating method to prepare an electrophotographic photoreceptor 1.

Protective Layer Coating Liquid

| | |
|---|---|
| Alumina (AA-03 ® having an average primary particle diameter of 0.3 μm from Sumitomo Chemical Co., Ltd.) | 2 |
| Compound having the formula 1-1 | 0.5 |
| Unsaturated polycarboxylate polymer liquid (BYK-P104 having an acid value of 180 mg KOH/g from BYK Chemie Co., Ltd.) | 0.02 |
| CTM having the following formula: | 3.5 |

-continued

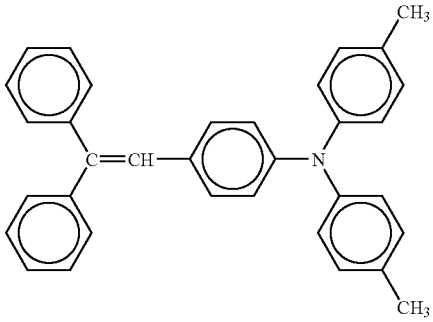

| | |
|---|---|
| Polycarbonate (Z-polyca from Teijin Chemicals, Ltd.) | 6 |
| Tetrahydrofuran | 220 |
| Cyclohexanone | 80 |

Example 2

The procedure for preparation of the electrophotographic photoreceptor in Example 1 was repeated except that the unsaturated polycarboxylate polymer included in the protective layer was changed to the following material to prepare an electrophotographic photoreceptor 2.

| | |
|---|---|
| Unsaturated polycarboxylate polymer (BYK-P105 ® having an acid value of 365 mg KOH/g from BYK Chemie Co., Ltd.) | 0.02 |

Example 3

The procedure for preparation of the electrophotographic photoreceptor in Example 1 was repeated except that the unsaturated polycarboxylate polymer included in the protective layer was changed to the following material to prepare an electrophotographic photoreceptor 3.

| | |
|---|---|
| Polyester resin (having an acid value of 35 mg KOH/g) | 0.2 |

Example 4

The procedure for preparation of the electrophotographic photoreceptor in Example 1 was repeated except that the unsaturated polycarboxylate polymer included in the protective layer was changed to the following material to prepare an electrophotographic photoreceptor 4.

| | |
|---|---|
| Polyester resin (having an acid value of 50 mg KOH/g) | 0.2 |

Example 5

The procedure for preparation of the electrophotographic photoreceptor in Example 1 was repeated except that the unsaturated polycarboxylate polymer included in the protective layer was changed to the following material to prepare an electrophotographic photoreceptor 5.

| | |
|---|---|
| Acrylic resin (BR-605 ® having an acid value of 65 mg KOH/g from Mitsubishi Rayon Co., Ltd.) | 0.1 |

Example 6

The procedure for preparation of the electrophotographic photoreceptor in Example 1 was repeated except that the unsaturated polycarboxylate polymer included in the protective layer was changed to the following material to prepare an electrophotographic photoreceptor 6.

| | |
|---|---|
| Acrylic resin/hydroxyethylmethacrylate (having an acid value of 50 mg KOH/g) | 0.1 |

Example 7

The procedure for preparation of the electrophotographic photoreceptor in Example 1 was repeated except that the unsaturated polycarboxylate polymer included in the protective layer was changed to the following material to prepare an electrophotographic photoreceptor 7.

| | |
|---|---|
| Monoalkylmaleate/styrene/butylacrylate (having an acid value of 50 mg KOH/g) | 0.1 |

Example 8

The procedure for preparation of the electrophotographic photoreceptor in Example 1 was repeated except that the unsaturated polycarboxylate polymer included in the protective layer was changed to the following material to prepare an electrophotographic photoreceptor 8.

| | |
|---|---|
| Styrene acrylic copolymer (FB-1522 ® having an acid value of 200 mg KOH/g from Mitsubishi Rayon Co., Ltd.) | 0.1 |

Example 9

The procedure for preparation of the electrophotographic photoreceptor in Example 1 was repeated except that the unsaturated polycarboxylate polymer included in the protective layer was changed to the following material to prepare an electrophotographic photoreceptor 9.

| | |
|---|---|
| Unsaturated polycarboxylate polymer liquid (having an acid value of 650 mgKOH/g from Fujisawa Pharmaceutical Co., Ltd.) | 0.02 |

Example 10

The procedure for preparation of the electrophotographic photoreceptor in Example 2 was repeated except that a content of the unsaturated polycarboxylate polymer included in the protective layer was changed to the following content to prepare an electrophotographic photoreceptor 10.

| | |
|---|---|
| Unsaturated polycarboxylate polymer liquid (BYK-P105 ® having an acid value of 365 mg KOH/g from BYK Chemie Co., Ltd.) | 0.001 |

Example 11

The procedure for preparation of the electrophotographic photoreceptor in Example 2 was repeated except that a content of the unsaturated polycarboxylate polymer included in the protective layer was changed to the following content to prepare an electrophotographic photoreceptor 11.

| | |
|---|---|
| Unsaturated polycarboxylate polymer liquid (BYK-P105 ® having an acid value of 365 mg KOH/g from BYK Chemie Co., Ltd.) | 0.1 |

Example 12

The procedure for preparation of the electrophotographic photoreceptor in Example 5 was repeated except that a content of the unsaturated polycarboxylate polymer included in the protective layer was changed to the following content to prepare an electrophotographic photoreceptor 12.

| | |
|---|---|
| Acrylic resin (BR-605 ® having an acid value of 65 mg KOH/g from Mitsubishi Rayon Co., Ltd.) | 0.5 |

Example 13

The procedure for preparation of the electrophotographic photoreceptor in Example 1 was repeated except that the filler included in the protective layer was changed to the following material to prepare an electrophotographic photoreceptor 13.

| | |
|---|---|
| Titanium oxide (CR-97 ® having an average primary particle diameter of 0.3 μm from Ishihara Sangyo Kaisha, Ltd.) | 2 |

Example 14

The procedure for preparation of the electrophotographic photoreceptor in Example 1 was repeated except that the filler included in the protective layer was changed to the following material to prepare an electrophotographic photoreceptor 14.

| | |
|---|---|
| Titanium oxide treated with silane coupling agent (MT100SA ® having an average primary particle diameter of 0.015 μm and a treated amount of 20% from Tayca Corp.) | 2 |

Example 15

The procedure for preparation of the electrophotographic photoreceptor in Example 1 was repeated except that the filler included in the protective layer was changed to the following material to prepare an electrophotographic photoreceptor 15.

| | |
|---|---|
| Silica (KMPX100 ® having an average primary particle diameter of 0.1 μm from Shin-Etsu Silicone Co., Ltd.) | 2 |

Example 16

The procedure for preparation of the electrophotographic photoreceptor in Example 1 was repeated except that the charge transport material and the binder resin included in the protective layer were changed to the following material to prepare an electrophotographic photoreceptor 16.

| | |
|---|---|
| Charge transport polymer material having the following formula: | 20 |

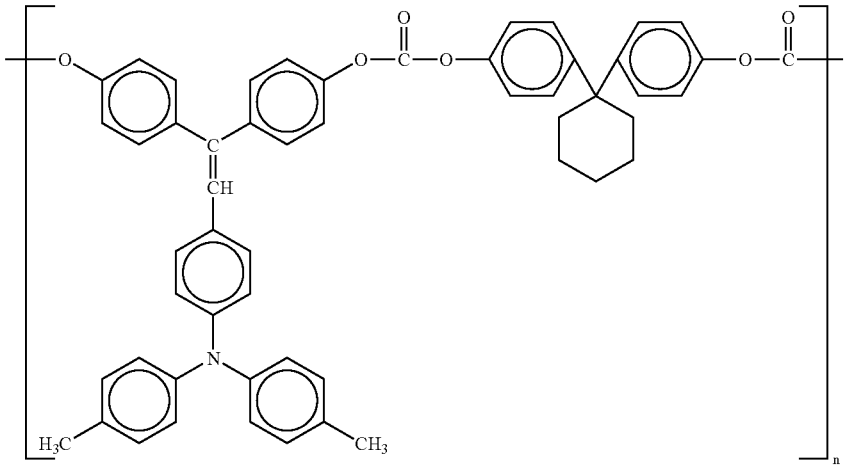

Example 17

The procedure for preparation of the electrophotographic photoreceptor in Example 1 was repeated except that the binder resin included in the protective layer was changed to the following material to prepare an electrophotographic photoreceptor 17.

| | |
|---|---|
| Polyacrylate resin (U-polymer U6000 ® from Unitika Ltd.) | 10 |

Example 18

The procedure for preparation of the electrophotographic photoreceptor in Example 1 was repeated except that compositions of the charge generation layer coating liquid, charge transport layer coating liquid and protective layer coating liquid were changed to the following compositions to prepare an electrophotographic photoreceptor 18.

Charge Generation Layer Coating Liquid

| | |
|---|---|
| Titanylphthalocyanine having the XD spectrum in FIG. 12 | 8 |
| Polyvinylbutyral | 5 |
| 2-butanone | 400 |

Charge Transport Layer Coating Liquid

| | |
|---|---|
| C-type polycarbonate | 10 |
| CTM having the following formula: | 8 |

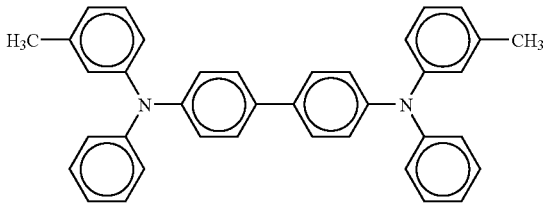

| | |
|---|---|
| Toluene | 70 |

Protective Layer Coating Liquid

| | |
|---|---|
| Titanium oxide treated with alumina (having an average primary particle diameter of 0.035 μm from Tayca Corp.) | 1.5 |
| Compound having the formula 1-1 | 0.5 |
| Methacrylic acid/methylmethacrylate copolymer (having an acid value 50 mgKOH/g) | 0.5 |
| C-type polycarbonate (from Teijin Chemicals, Ltd.) | 5.5 |
| CTM having the following formula: | 4 |

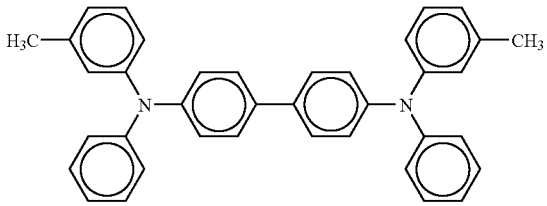

| | |
|---|---|
| Tetrahydrofuran | 250 |
| Cyclohexanone | 50 |

Example 19

The procedure for preparation of the electrophotographic photoreceptor in Example 1 was repeated except that a content of the unsaturated polycarboxylate polymer included in the protective layer was changed to the following content to prepare an electrophotographic photoreceptor 19.

| | |
|---|---|
| Unsaturated polycarboxylate polymer liquid (BYK-P105 ® having an acid value of 365 mg KOH/g from BYK Chemie Co., Ltd.) | 0.002 |

Example 20

The procedure for preparation of the electrophotographic photoreceptor in Example 1 was repeated except that the filler included in the protective layer was changed to the following material to prepare an electrophotographic photoreceptor 20.

| | |
|---|---|
| Silica (having an average primary particle diameter of 0.015 μm from Shin-Etsu Silicone Co., Ltd.) | 2 |

Comparative Example 1

The procedure for preparation of the electrophotographic photoreceptor in Example 1 was repeated except that a composition of the protective layer coating liquid was changed to the following composition to prepare a comparative electrophotographic photoreceptor 1 (the organic compound having an acid value of from 10 to 700 (mgKOH/g) was not included).

Protective Layer Coating Liquid

| | |
|---|---|
| Alumina (AA-03 having an average primary particle diameter of 0.3 μm from Sumitomo Chemical Co., Ltd.) | 2 |
| Compound having the formula 1-1 | 0.5 |
| CTM having the following formula: | 4 |

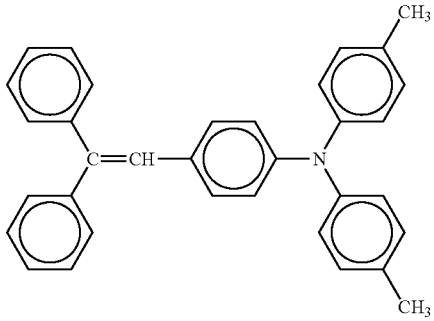

| | |
|---|---|
| Polycarbonate (Z-polyca from Teijin Chemicals, Ltd.) | 6 |
| Tetrahydrofuran | 220 |
| Cyclohexanone | 80 |

Comparative Example 2

The procedure of preparation for the electrophotographic photoreceptor in Example 3 was repeated except that a composition of the protective layer coating liquid was changed to the following composition to prepare a comparative electrophotographic photoreceptor 2 (the organic compound included in the protective layer coating liquid had an acid value less than 10 (mg KOH/g)).

Protective Layer Coating Liquid

| | |
|---|---|
| Alumina (AA-03 having an average primary particle diameter of 0.3 μm from Sumitomo Chemical Co., Ltd.) | 2 |
| Compound having the formula 1-1 | 0.5 |
| Polyester resin (having an acid value of 7 mg KOH/g) | 0.2 |
| CTM having the following formula: | 4 |

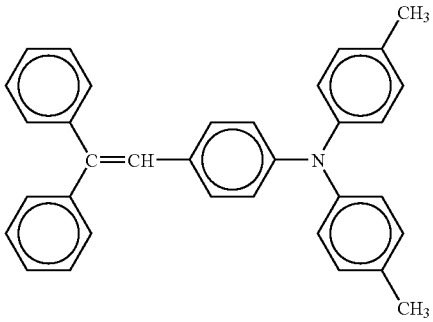

| | |
|---|---|
| Polycarbonate (Z-polyca from Teijin Chemicals, Ltd.) | 6 |
| Tetrahydrofuran | 220 |
| Cyclohexanone | 80 |

Comparative Example 3

The procedure of preparation for the electrophotographic photoreceptor in Example 3 was repeated except that a composition of the protective layer coating liquid was changed to the following composition to prepare a comparative electrophotographic photoreceptor 3 (the compound having the formula (1) or (2) was not included).

Protective Layer Coating Liquid

| | |
|---|---|
| Alumina (AA-03 having an average primary particle diameter of 0.3 μm from Sumitomo Chemical Co., Ltd.) | 2 |
| Unsaturated polycarboxylate polymer liquid (having an acid value of 180 mg KOH/g from BYK Chemie Co., Ltd.) | 0.02 |
| CTM having the following formula: | 4 |

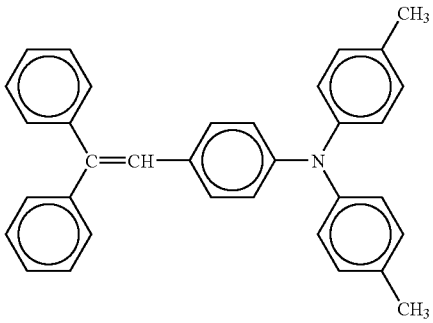

| | |
|---|---|
| Polycarbonate (Z-polyca from Teijin Chemicals, Ltd.) | 6 |

-continued

| | |
|---|---|
| Tetrahydrofuran | 220 |
| Cyclohexanone | 80 |

Examples 21 to 38 and Comparative Examples 4 and 5

The procedures for preparation of the electrophotographic photoreceptors in Examples 1 to 18 and Comparative Examples 1 and 2 were repeated except that the compound having the formula 1-1 included in the protective layer was changed to a compound having the formula 2-1 to prepare electrophotographic photoreceptors 21 to 38 and comparative electrophotographic photoreceptors 4 and 5.

Examples 39 to 48

The procedure for preparation of the electrophotographic photoreceptor in Example 1 was repeated except that the compound having the formula 1-1 included in the protective layer was changed to compounds shown in after-mentioned Table 7 to prepare electrophotographic photoreceptors 39 to 48.

Example 49

The procedure for preparation of the electrophotographic photoreceptor in Example 21 was repeated except that a content of the polycarboxylic acid included in the protective layer was changed to the content thereof in Example 19 to prepare an electrophotographic photoreceptor 49.

Example 50

The procedure for preparation of the electrophotographic photoreceptor in Example 21 was repeated except that the filler included in the protective layer was changed to the filler in Example 13 to prepare an electrophotographic photoreceptor 50.

Example 51

The procedure for preparation of the electrophotographic photoreceptor in Example 21 was repeated except that the filler included in the protective layer was changed to the filler in Example 14 to prepare an electrophotographic photoreceptor 51.

Example 52

The procedure for preparation of the electrophotographic photoreceptor in Example 21 was repeated except that the filler included in the protective layer was changed to the filler in Example 20 to prepare an electrophotographic photoreceptor 52.

Example 53

The procedure for preparation of the electrophotographic photoreceptor in Example 21 was repeated except that the charge transport material and binder resin included in the protective layer were changed to those in Example 16 to prepare an electrophotographic photoreceptor 53.

Example 54

The procedure for preparation of the electrophotographic photoreceptor in Example 21 was repeated except that the binder resin included in the protective layer was changed to that in Example 17 to prepare an electrophotographic photoreceptor 54.

Example 55

The procedure for preparation of the electrophotographic photoreceptor in Example 21 was repeated except that compositions of the charge generation layer coating liquid and charge transport layer coating liquid were changed to those in Example 18, and that a composition of the protective layer coating liquid was changed to the following composition to prepare an electrophotographic photoreceptor 18.

Protective Layer Coating Liquid

| | |
|---|---|
| Titanium oxide treated with alumina (having an average primary particle diameter of 0.035 μm from Tayca Corp.) | 1.5 |
| Compound having the formula 2-1 | 0.5 |
| Methacrylic acid/methylmethacrylate copolymer (having an acid value 50 mgKOH/g) | 0.5 |
| C-type polycarbonate (from Teijin Chemicals, Ltd.) | 5.5 |
| CTM having the following formula: | 4 |

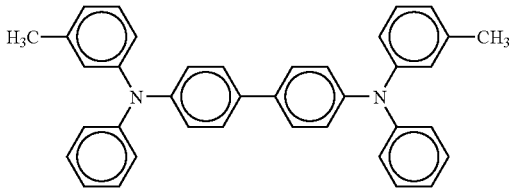

| | |
|---|---|
| Tetrahydrofuran | 250 |
| Cyclohexanone | 50 |

Comparative Example 6

The procedure for preparation of the electrophotographic photoreceptor in Example 21 was repeated except that a composition of the protective layer coating liquid was changed to the following composition to prepare a comparative electrophotographic photoreceptor 6 (the organic compound having an acid value of from 10 to 700 (mgKOH/g) was not included).

Protective Layer Coating Liquid

| | |
|---|---|
| Alumina (AA-03 having an average primary particle diameter of 0.3 μm from Sumitomo Chemical Co., Ltd.) | 2 |
| Compound having the formula 3-2 | 0.5 |
| CTM having the following formula: | 4 |

-continued

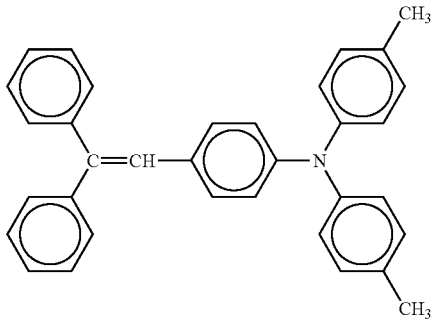

| | |
|---|---|
| Polycarbonate (Z-polyca from Teijin Chemicals, Ltd.) | 6 |
| Tetrahydrofuran | 220 |
| Cyclohexanone | 80 |

Comparative Example 7

The procedure of preparation for the electrophotographic photoreceptor in Example 23 was repeated except that a composition of the protective layer coating liquid was changed to the following composition to prepare a comparative electrophotographic photoreceptor 7 (the organic compound included in the protective layer coating liquid had an acid value less than 10 (mg KOH/g)).

Protective Layer Coating Liquid

| | |
|---|---|
| Alumina (AA-03 having an average primary particle diameter of 0.3 μm from Sumitomo Chemical Co., Ltd.) | 2 |
| Compound having the formula 2-1 | 0.5 |
| Polyester resin (having an acid value of 7 mg KOH/g) | 0.2 |
| CTM having the following formula: | 4 |

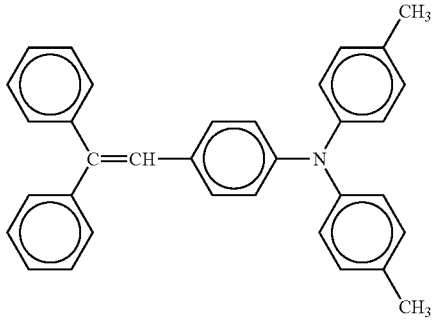

| | |
|---|---|
| Polycarbonate (Z-polyca from Teijin Chemicals, Ltd.) | 6 |
| Tetrahydrofuran | 220 |
| Cyclohexanone | 80 |

The thus prepared electrophotographic photoreceptors 1 to 55 and comparative electrophotographic photoreceptors 1 to 7 were loaded in an electrophotographic process cartridge. After the cartridge was fixed in a modified copier imagio MF2200 from Ricoh Company, Ltd. using a corona charger (scorotron) and a laser diode having a wavelength of 655 nm as an imagewise light source and having a dark portion potential of 900 (−V), continuous 50,000 images were produced. The initial image quality and the image quality after 50,000 images were produced were evaluated. In addition, the initial bright portion potential and the bright portion potential after 50,000 images were produced were measured. Further, the abrasion amount was evaluated from a difference between the initial thickness and the thickness after 50,000 images were produced.

TABLE 5

| | | | Initial | | After 50,000 images were produced | | |
|---|---|---|---|---|---|---|---|
| Ex. No. | Photo-receptor No. | Compound No. | Bright portion potential (−V) | Image quality | Bright portion potential (−V) | Image quality | Abrasion amount (μm) |
| Ex. 1 | 1 | 1-1 | 120 | Good | 155 | Good | 0.50 |
| Ex. 2 | 2 | 1-1 | 115 | Good | 155 | Good | 0.50 |
| Ex. 3 | 3 | 1-1 | 165 | Good | 225 | Good | 0.51 |
| Ex. 4 | 4 | 1-1 | 145 | Good | 220 | Good | 0.51 |
| Ex. 5 | 5 | 1-1 | 150 | Good | 205 | Good | 0.50 |
| Ex. 6 | 6 | 1-1 | 120 | Good | 175 | Good | 0.51 |
| Ex. 7 | 7 | 1-1 | 120 | Good | 170 | Good | 0.50 |
| Ex. 8 | 8 | 1-1 | 125 | Good | 180 | Good | 0.52 |
| Ex. 9 | 9 | 1-1 | 115 | Good | 150 | Good | 0.50 |
| Ex. 10 | 10 | 1-1 | 215 | Good | 305 | Image density lowered | 0.57 |
| Ex. 11 | 11 | 1-1 | 130 | Good | 170 | Good | 0.52 |
| Ex. 12 | 12 | 1-1 | 125 | Good | 195 | Good | 0.54 |
| Ex. 13 | 13 | 1-1 | 140 | Good | 190 | Good | 0.55 |
| Ex. 14 | 14 | 1-1 | 130 | Good | 175 | Good | 0.71 |
| Ex. 15 | 15 | 1-1 | 120 | Good | 170 | Good | 0.80 |
| Ex. 16 | 16 | 1-1 | 120 | Good | 175 | Good | 0.53 |
| Ex. 17 | 17 | 1-1 | 140 | Good | 190 | Good | 0.49 |
| Ex. 18 | 18 | 1-1 | 130 | Good | 185 | Good | 0.45 |
| Ex. 19 | 19 | 1-1 | 130 | Good | 170 | Good | 0.55 |
| Ex. 20 | 20 | 1-1 | 120 | Good | 170 | Good | 0.80 |
| Com. Ex. 1 | Com. 1 | 1-1 | 275 | Image density slightly lowered | 405 | Image density largely lowered, not readable | 1.01 |
| Com. Ex. 2 | Com. 2 | 1-1 | 255 | Image density slightly lowered | 370 | Image density largely lowered, not readable | 0.94 |
| Com. Ex. 3 | Com. 3 | 1-1 | 125 | Good | 160 | Image resolution largely lowered | 0.52 |

TABLE 6

| | | | Initial | | After 50,000 images were produced | | |
|---|---|---|---|---|---|---|---|
| Ex. No. | Photo-receptor No. | Compound No. | Bright portion potential (−V) | Image quality | Bright portion potential (−V) | Image quality | Abrasion amount (μm) |
| Ex. 21 | 21 | 2-1 | 110 | Good | 145 | Good | 0.49 |
| Ex. 22 | 22 | 2-1 | 105 | Good | 150 | Good | 0.50 |
| Ex. 23 | 23 | 2-1 | 155 | Good | 210 | Good | 0.50 |
| Ex. 24 | 24 | 2-1 | 135 | Good | 200 | Good | 0.52 |
| Ex. 25 | 25 | 2-1 | 140 | Good | 190 | Good | 0.51 |
| Ex. 26 | 26 | 2-1 | 115 | Good | 165 | Good | 0.52 |
| Ex. 27 | 27 | 2-1 | 110 | Good | 155 | Good | 0.50 |
| Ex. 28 | 28 | 2-1 | 145 | Good | 200 | Good | 0.55 |
| Ex. 29 | 29 | 2-1 | 105 | Good | 145 | Good | 0.51 |
| Ex. 30 | 30 | 2-1 | 200 | Good | 300 | Image density lowered | 0.54 |
| Ex. 31 | 31 | 2-1 | 105 | Good | 145 | Good | 0.51 |
| Ex. 32 | 32 | 2-1 | 120 | Good | 180 | Good | 0.59 |

TABLE 6-continued

| Ex. No. | Photo-receptor No. | Compound No. | Initial: Bright portion potential (−V) | Initial: Image quality | After 50,000 images were produced: Bright portion potential (−V) | After 50,000 images were produced: Image quality | Abrasion amount (μm) |
|---|---|---|---|---|---|---|---|
| Ex. 33 | 33 | 2-1 | 130 | Good | 180 | Good | 0.57 |
| Ex. 34 | 34 | 2-1 | 120 | Good | 165 | Good | 0.72 |
| Ex. 35 | 35 | 2-1 | 110 | Good | 160 | Good | 0.79 |
| Ex. 36 | 36 | 2-1 | 110 | Good | 160 | Good | 0.52 |
| Ex. 37 | 37 | 2-1 | 130 | Good | 170 | Good | 0.49 |
| Ex. 38 | 38 | 2-1 | 125 | Good | 170 | Good | 0.44 |
| Com. Ex. 4 | Com. 4 | 2-1 | 265 | Image density lowered | 380 | Image density largely lowered, not readable | 1.02 |
| Com. Ex. 5 | Com. 5 | 2-1 | 240 | Image density lowered | 350 | Image density largely lowered, not readable | 0.93 |

TABLE 7

| Ex. No. | Photo-receptor No. | Compound No. | Initial: Bright portion potential (−V) | Initial: Image quality | After 50,000 images were produced: Bright portion potential (−V) | After 50,000 images were produced: Image quality | Abrasion amount (μm) |
|---|---|---|---|---|---|---|---|
| Ex. 39 | 39 | 1-2 | 110 | Good | 150 | Good | 0.50 |
| Ex. 40 | 40 | 1-5 | 120 | Good | 150 | Good | 0.51 |
| Ex. 41 | 41 | 1-8 | 105 | Good | 155 | Good | 0.50 |
| Ex. 42 | 42 | 1-11 | 110 | Good | 155 | Good | 0.51 |
| Ex. 43 | 43 | 1-15 | 130 | Good | 170 | Good | 0.51 |
| Ex. 44 | 44 | 2-4 | 115 | Good | 140 | Good | 0.51 |
| Ex. 45 | 45 | 2-6 | 120 | Good | 145 | Good | 0.51 |
| Ex. 46 | 46 | 2-7 | 120 | Good | 135 | Good | 0.51 |
| Ex. 47 | 47 | 2-9 | 115 | Good | 140 | Good | 0.50 |
| Ex. 48 | 48 | 2-14 | 130 | Good | 160 | Good | 0.51 |

TABLE 8

| Ex. No. | Photo-receptor No. | Compound No. | Initial: Bright portion potential (−V) | Initial: Image quality | After 50,000 images were produced: Bright portion potential (−V) | After 50,000 images were produced: Image quality | Abrasion amount (μm) |
|---|---|---|---|---|---|---|---|
| Ex. 49 | 49 | 2-1 | 120 | Good | 160 | Good | 0.52 |
| Ex. 50 | 50 | 2-1 | 130 | Good | 180 | Good | 0.57 |
| Ex. 51 | 51 | 2-1 | 120 | Good | 165 | Good | 0.72 |
| Ex. 52 | 52 | 2-1 | 110 | Good | 160 | Good | 0.79 |
| Ex. 53 | 53 | 2-1 | 110 | Good | 160 | Good | 0.52 |
| Ex. 54 | 54 | 2-1 | 130 | Good | 170 | Good | 0.49 |
| Ex. 55 | 55 | 2-1 | 125 | Good | 170 | Good | 0.44 |
| Com. Ex. 6 | Com. 6 | 2-1 | 265 | Image density lowered | 380 | Image density largely lowered, not readable | 1.02 |
| Com. Ex. 7 | Com. 7 | 2-1 | 240 | Image density lowered | 350 | Image density largely | 0.93 |

TABLE 8-continued

| Ex. No. | Photo-receptor No. | Compound No. | Initial: Bright portion potential (−V) | Initial: Image quality | After 50,000 images were produced: Bright portion potential (−V) | After 50,000 images were produced: Image quality | After 50,000 images were produced: Abrasion amount (μm) |
|---|---|---|---|---|---|---|---|
| | | | | | | lowered, not readable | |

The evaluation results of Tables 5 to 8 show that the bright portion potential could be largely decreased when an organic compound having an acid value of from 10 to 700 (mg KOH/g) was included in outermost layers of the photoreceptors. Further, even after 50,000 images were produced, the bright portion potential did not increase much, and the photoreceptors including the compound having the formulae (1) and/or (2) stably produced high quality images. In addition, at the same time, the abrasion amount was controlled and the abrasion resistance largely improved. To the contrary, the photoreceptors not including the organic compound having an acid value of from 10 to 700 (mg KOH/g) and including an organic compound having an acid value less than 10 (mg KOH/g) had high bright portion potentials from the beginning, which caused deterioration of image density and resolution. In addition, images after 50,000 images were produced could not be readable because tone reproducibility largely deteriorated. Further, the abrasion amount of these photoreceptors largely increased and the abrasion resistance thereof largely deteriorated.

In addition, the photoreceptors 1, 11, 21, 31, and 39 to 48 were left in a desiccator having a NOx gas concentration of 50 ppm for 4 days to evaluate images (image resolutions) before and after they were left therein.

TABLE 9

| Photoreceptor No. | Initial image resolution (number/mm) | Image resolution after left in the desiccator (number/mm) |
|---|---|---|
| 1 | 8.0 | 8.0 |
| 11 | 8.0 | 7.2 |
| Com. 3 | 8.0 | 2.8 |
| 21 | 8.0 | 8.0 |
| 31 | 8.0 | 7.2 |
| 39 | 8.0 | 8.0 |
| 40 | 8.0 | 8.0 |
| 41 | 8.0 | 8.0 |
| 42 | 8.0 | 8.0 |
| 43 | 8.0 | 8.0 |
| 44 | 8.0 | 8.0 |
| 45 | 8.0 | 8.0 |
| 46 | 8.0 | 8.0 |
| 47 | 8.0 | 8.0 |
| 48 | 8.0 | 8.0 |

The evaluation results of Table 9 show that the photoreceptors including the compound having the formulae (1) and/or (2) in outermost layers had largely improved resistance against an oxidized gas. Image resolutions of the photoreceptors 11 and 32 having large acid value equivalents slightly deteriorated although practically of no matter.

Example 56

A coating liquid B having the following composition for forming a protective layer of an electrophotographic photoreceptor was prepared.

Protective Layer Coating Liquid

| | |
|---|---|
| Alumina (AA-03 having an average primary particle diameter of 0.3 μm from Sumitomo Chemical Co., Ltd.) | 2 |
| Compound having the formula 1-1 | 0.5 |
| Unsaturated polycarboxylate polymer liquid (having an acid value of 180 mg KOH/g from BYK Chemie Co., Ltd.) | 0.02 |
| CTM having the following formula: | 3.5 |

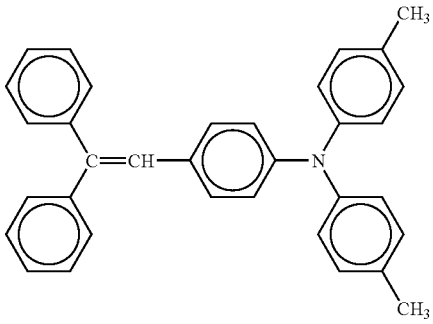

| | |
|---|---|
| Polycarbonate (Z-polyca from Teijin Chemicals, Ltd.) | 6 |
| Hydroquinone compound having the following formula: | 0.005 |

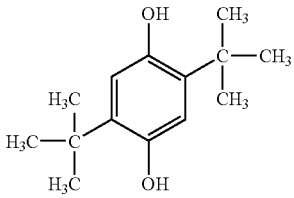

| | |
|---|---|
| Tetrahydrofuran | 220 |
| Cyclohexanone | 80 |

Example 57

The procedure for preparation of the coating liquid B for forming a protective layer of an electrophotographic photoreceptor in Example 56 was repeated except that the hydroquinone compound included in the liquid was changed to a hindered amine compound having the following formula to prepare a coating liquid C for forming a protective layer of an electrophotographic photoreceptor.

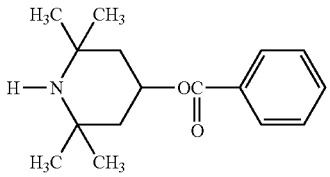

Example 58

The procedure of preparation for the coating liquid B for forming a protective layer of an electrophotographic photoreceptor in Example 56 was repeated except that the hydroquinone compound included in the liquid was changed to an organic sulfur compound having the following formula to prepare a coating liquid D for forming a protective layer of an electrophotographic photoreceptor.

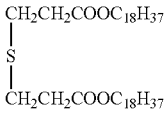

Example 59

The procedure of preparation for the coating liquid B for forming a protective layer of an electrophotographic photoreceptor in Example 56 was repeated except that the hydroquinone compound included in the liquid was changed to an organic sulfur compound having the following formula to prepare a coating liquid E for forming a protective layer of an electrophotographic photoreceptor.

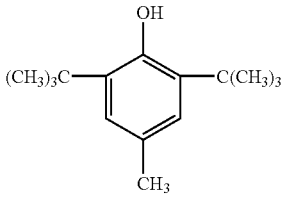

Example 60

The procedure of preparation for the coating liquid B for forming a protective layer of an electrophotographic photoreceptor in Example 56 was repeated except that the hydroquinone compound included in the liquid was changed to an organic sulfur compound having the following formula to prepare a coating liquid F for forming a protective layer of an electrophotographic photoreceptor.

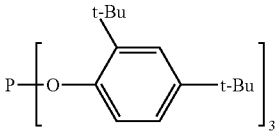

Examples 61 to 65

The procedures for preparation of the coating liquids B to F for forming a protective layer of an electrophotographic photoreceptor in Examples 56 to 60 were repeated except that the compound having the formula 1-1 included in the liquid was changed to an compound having the formula 2-1 to prepare coating liquids H to L forming a protective layer of an electrophotographic photoreceptor.

The thus prepared Example 1 (a coating liquid A for forming a protective layer of an electrophotographic photoreceptor), Example 21 (a coating liquid G for forming a protective layer of an electrophotographic photoreceptor) and Examples 56 to 65 (coating liquids B to F and H to L) for forming a protective layer of an electrophotographic photoreceptor) were left in a dark place at a room temperature for a week to evaluate changes of optical absorption properties of the coating liquids.

TABLE 10

| | Absorbance Variation Ratio at 665 nm |
|---|---|
| Coating Liquid A | 1.18 |
| Coating Liquid B | 1.01 |
| Coating Liquid C | 1.01 |
| Coating Liquid D | 1.07 |
| Coating Liquid E | 1.09 |
| Coating Liquid F | 1.11 |
| Coating Liquid G | 1.15 |
| Coating Liquid H | 1.01 |
| Coating Liquid I | 1.01 |
| Coating Liquid J | 1.05 |
| Coating Liquid K | 1.07 |
| Coating Liquid L | 1.08 |

(Absorbance Variation Ratio) = (Absorbance of the coating liquid after left in the place)/(Absorbance of the coating liquid right after prepared)

The results of Table 10 show that an antioxidant included in the liquid prevented production of salt and storage stability of the coating liquid for forming a protective layer of an electrophotographic photoreceptor was largely improved. In particular, the hydroquinone and hindered amine compounds significantly improved the storage stability.

This document claims priority and contains subject matter related to Japanese Patent Applications Nos. 2003-157204, 2003-166890, 2003-167080 and 2003-191403, filed on Jun. 2, 2003, Jun. 11, 2003, Jun. 11, 2003 and Jul. 3, 2003 respectively, incorporated herein by reference.

Having now fully described the invention, it will be apparent to one of ordinary skill in the art that many changes and modifications can be made thereto without departing from the spirit and scope of the invention as set forth therein.

What is claimed is:

1. A photoreceptor comprising:

an electroconductive substrate;

a photosensitive layer located overlying the electroconductive substrate; and optionally a protective layer located overlying the photosensitive layer, wherein an outermost layer of the photoreceptor comprises a filler, an organic compound having an acid value of from 10 to 700 mg KOH/g and at least one compound selected from the group consisting of compounds having the following formula (1):

(1)

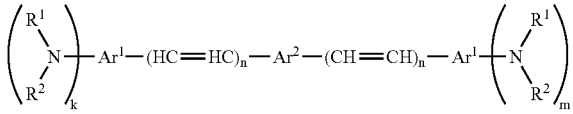

wherein $R^1$ and $R^2$ independently represent a substituted or an unsubstituted aromatic hydrocarbon group, or a substituted or an unsubstituted alkyl group, and optionally share bond connectivity to form a heterocyclic group including a nitrogen atom; $Ar^1$ and $Ar^2$ independently represent a substituted or a unsubstituted aromatic ring group; k and m independently represent 0 or an integer of from 1 to 3, wherein k and m are not 0 at the same time; and n represents an integer of from 1 to 3, and compounds having the following formula (2):

(2)

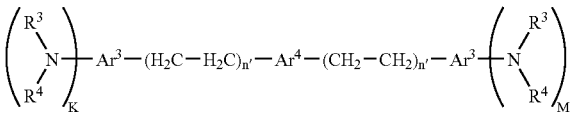

wherein $R^3$ and $R^4$ independently represent a substituted or an unsubstituted aromatic hydrocarbon group, or a substituted or an unsubstituted alkyl group, and optionally share bond connectivity to form a heterocyclic group including a nitrogen atom; $Ar^3$ and $Ar^4$ independently represent a substituted or a unsubstituted aromatic ring group; K and M independently represent 0 or an integer of from 1 to 3, wherein K and M are not 0 at the same time; and n' represents an integer of from 1 to 3.

2. The photoreceptor of claim 1, wherein the outermost layer thereof comprises at least one compound selected from the group consisting of compounds having the following formula (1):

(1)

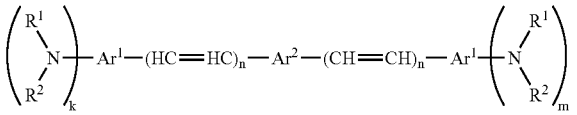

wherein $R^1$ and $R^2$ independently represent a substituted or an unsubstituted aromatic hydrocarbon group, or a substituted or an unsubstituted alkyl group, and optionally share bond connectivity to form a heterocyclic group including a nitrogen atom; $Ar^1$ and $Ar^2$ independently represent a substituted or a unsubstituted aromatic ring group; k and m independently represent 0 or an integer of from 1 to 3, wherein k and m are not 0 at the same time; and n represents an integer of from 1 to 3, and at least one compound selected from the group consisting of compounds having the following formula (2):

(2)

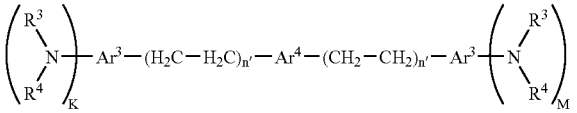

wherein $R^3$ and $R^4$ independently represent a substituted or an unsubstituted aromatic hydrocarbon group, or a substituted or an unsubstituted alkyl group, and optionally share bond connectivity to form a heterocyclic group including a nitrogen atom; $Ar^3$and $Ar^4$ independently represent a substituted or a unsubstituted aromatic ring group; K and M independently represent 0 or an integer of from 1 to 3, wherein K and M are not 0 at the same time; and n' represents an integer of from 1 to 3.

3. The photoreceptor of claim 1, wherein the outermost layer is the photosensitive layer.

4. The photoreceptor of claim 1, wherein the outermost layer is the protective layer.

5. The photoreceptor of claim 1, wherein the organic compound having an acid value of from 10 to 700 mg KOH/g is a polycarboxylic acid.

6. The photoreceptor of claim 5, wherein the polycarboxylic acid is a member selected from the group consisting of polyester resins, acrylic resins, copolymers including their structures and their mixtures.

7. The photoreceptor of claim 1, wherein the organic compound having an acid value of from 10 to 700 mg KOH/g comprises an organic fatty acid.

8. The photoreceptor of claim 1, wherein the filler is an inorganic pigment.

9. The photoreceptor of claim 8, wherein the inorganic pigment is a metal oxide.

10. The photoreceptor of claim 8, wherein the inorganic pigment has a pH not less than 5.

11. The photoreceptor of claim 8, wherein the inorganic pigment has a dielectric constant not less than 5.

12. The photoreceptor of claim 1, wherein the filler has an average primary particle diameter of from 0.01 to 0.5 μm.

13. The photoreceptor of claim 1, wherein the outermost layer further comprises a charge transport material.

14. The photoreceptor of claim 13, wherein the charge transport material is a charge transport polymer material.

15. The photoreceptor of claim 1, wherein the outermost layer further comprises at least one of a polycarbonate resin and a polyarylate resin.

16. An electrophotographic image forming method comprising:

charging the photoreceptor according to claim 1;

irradiating the photoreceptor with light to form an electrostatic latent image on a surface of the photoreceptor;

developing the electrostatic latent image with a toner to form a toner image on the photoreceptor; and transferring the toner image onto a receiving material.

17. The image forming method according to claim 16, wherein the irradiating step includes digitally irradiating light using at least one of a laser diode and a light emitting diode.

18. An electrophotographic image forming apparatus comprising:

the photoreceptor according to claim 1;

a charger configured to charge the photoreceptor;

an irradiator configured to irradiate the photoreceptor with light to form an electrostatic latent image on the photoreceptor;

an image developer configured to develop the electrostatic latent image with a toner to form a toner image on the photoreceptor; and a transferer configured to transfer the toner image onto a receiving material.

19. The image forming apparatus according to claim 18, wherein the irradiator comprises one of a laser diode and a light emitting diode configured to emit the light.

20. A process cartridge comprising:

the electrophotographic photoreceptor according to claim 1; and at least one member selected from the group consisting of chargers, irradiators, image developers, transferers, cleaners and dischargers.

21. The photoreceptor of claim 1, comprising a compound of formula (1).

22. The photoreceptor of claim 1, comprising a compound of formula (2).

23. The photoreceptor of claim 1, comprising at least one selected from the group consisting of

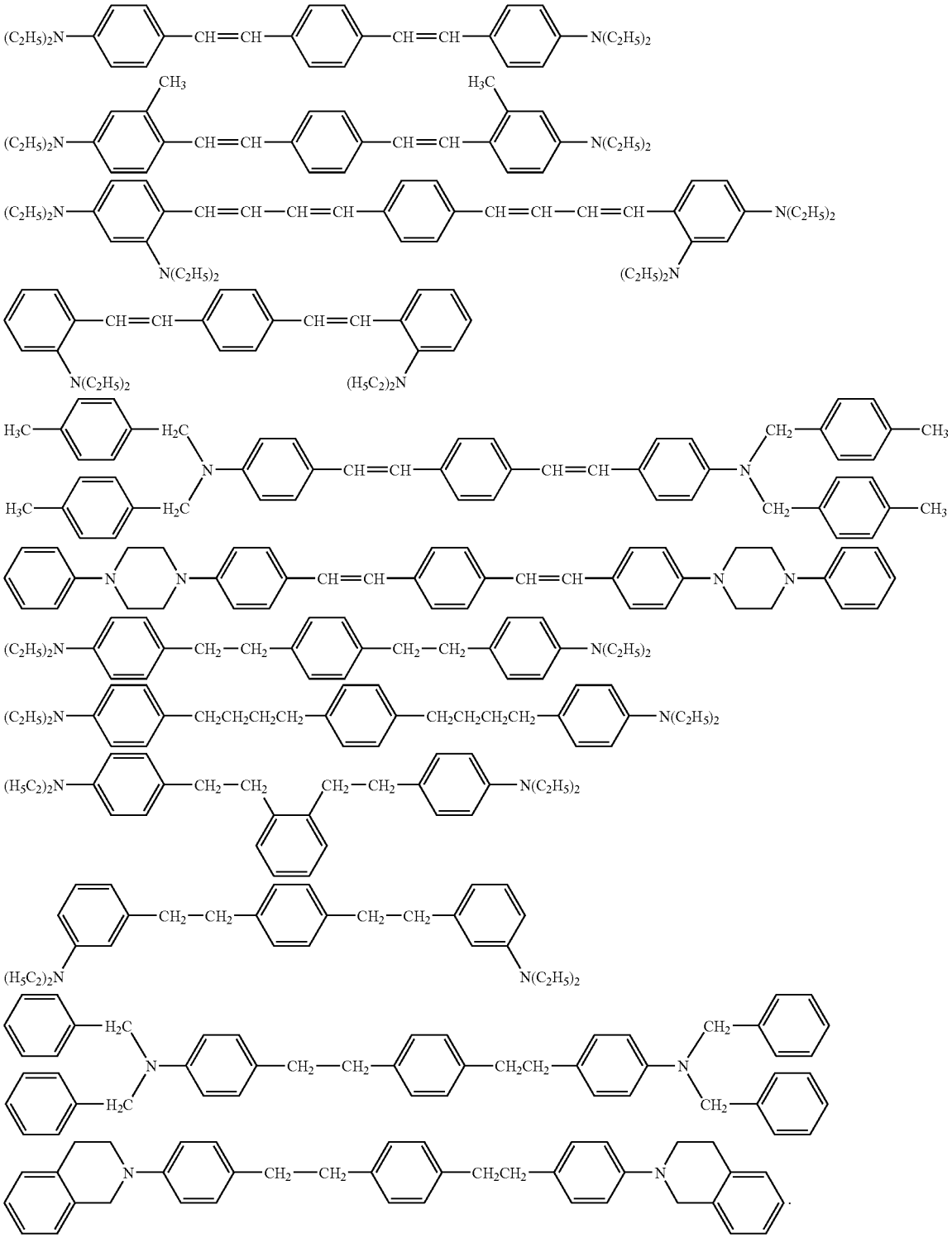

* * * * *